US007321255B2

(12) United States Patent
Maki

(10) Patent No.: US 7,321,255 B2
(45) Date of Patent: Jan. 22, 2008

(54) VOLTAGE GENERATING CIRCUIT, DATA DRIVER AND DISPLAY UNIT

(75) Inventor: Katsuhiko Maki, Nagano (JP)

(73) Assignee: Seiko Epson Corporation (JP)

( * ) Notice: Subject to any disclaimer, the term of this patent is extended or adjusted under 35 U.S.C. 154(b) by 105 days.

(21) Appl. No.: 11/071,775

(22) Filed: Mar. 3, 2005

(65) Prior Publication Data

US 2005/0195652 A1 Sep. 8, 2005

(30) Foreign Application Priority Data

Mar. 8, 2004 (JP) ..... 2004-064090

(51) Int. Cl.
*G05F 1/10* (2006.01)

(52) U.S. Cl. ..... 327/538; 327/540; 327/541; 327/542; 327/543; 323/313; 323/314; 323/315; 323/316

(58) Field of Classification Search ..... None
See application file for complete search history.

(56) References Cited

U.S. PATENT DOCUMENTS

| | | | | |
|---|---|---|---|---|
| 5,243,333 | A | 9/1993 | Shiba et al. | 345/100 |
| 5,376,839 | A * | 12/1994 | Horiguchi et al. | 327/541 |
| 6,297,624 | B1 * | 10/2001 | Mitsui et al. | 323/316 |
| 6,509,860 | B2 | 1/2003 | Saito | 341/155 |
| 6,781,443 | B2 * | 8/2004 | Hamamoto et al. | 327/541 |
| 6,809,576 | B1 * | 10/2004 | Yamasaki | 327/540 |
| 6,919,870 | B2 | 7/2005 | Fukuda | 345/90 |
| 7,071,669 | B2 | 7/2006 | Morita | 323/297 |
| 2003/0071679 | A1 * | 4/2003 | Kono et al. | 327/538 |
| 2006/0049817 | A1 * | 3/2006 | Gerstmeier et al. | 323/313 |
| 2006/0103451 | A1 * | 5/2006 | Lim et al. | 327/540 |

FOREIGN PATENT DOCUMENTS

| | | |
|---|---|---|
| JP | 54-036172 | 3/1979 |
| JP | 55-018016 | 2/1980 |
| JP | 56-60114 | 5/1981 |

(Continued)

OTHER PUBLICATIONS

Communication from Japanese Patent Office regarding corresponding application, Mar. 3, 2005.

(Continued)

*Primary Examiner*—Tuan T. Lam
*Assistant Examiner*—Hiep Nguyen
(74) *Attorney, Agent, or Firm*—Harness, Dickey & Pierce, P.L.C.

(57) ABSTRACT

A voltage generating circuit outputs a generated voltage corresponding to (a+b+c)-bit digital data from a plurality of generated voltages. The voltage generating circuit includes a first selector of each conductive type and $2^a$ pieces of second selectors of each conductive type. Each first selector is constituted by the conductive type MOS transistor, and based on upper order a-bit of the digital data, outputs one of the generated voltages selected corresponding to low order (b+c)-bit of the digital data. Each second selector is constituted by the conductive type MOS transistor, and based on low order a-bit of the digital data, outputs one of the generated voltages to the first selector of the conductive type. One output and the other outputs of the first selectors of both conductive types are connected to one another.

7 Claims, 17 Drawing Sheets

FOREIGN PATENT DOCUMENTS

| | | |
|---|---|---|
| JP | 56-060114 | 5/1981 |
| JP | 60-112328 | 6/1985 |
| JP | 01-238225 | 9/1989 |
| JP | 1-238225 | 9/1989 |
| JP | 04-358418 | 12/1992 |
| JP | 5-35211 | 2/1993 |
| JP | 06-029855 | 2/1994 |
| JP | 6-303141 | 10/1994 |
| JP | 06-303141 | 10/1994 |
| JP | 2001-188615 | 7/2001 |
| JP | 2002-6812 | 1/2002 |
| JP | 2002-111461 | 4/2002 |
| JP | 2003-233354 | 8/2003 |
| JP | 2003-233357 | 8/2003 |

OTHER PUBLICATIONS

Communication from Japanese Patent Office re: related application, Mar. 3, 2005.

* cited by examiner

VOLTAGE GENERATING CIRCUIT, DATA DRIVER AND DISPLAY UNIT

RELATED APPLICATIONS

This application claims priority to Japanese Patent Application No. 2004-064090 filed Mar. 8, 2004 which is hereby expressly incorporated by reference herein in its entirety.

BACKGROUND

1. Field of the Invention

The present invention relates to a voltage generating circuit, a data driver, and a display unit.

2. Related Art

As a liquid crystal panel (electro-optical device) used in electronic equipment such as a mobile phone, there are conventionally known a liquid crystal panel of a simple matrix method and a liquid crystal panel of an active matrix method using a switching element such as a thin film transistor (hereinafter abbreviated as TFT).

The simple matrix method has an advantage of being easy to produce low power consumption as compared to the active matrix method, while its disadvantage is its difficulty to produce multi-color and display animation. On the other hand, the active matrix method has an advantage of being suited to multi-color production and animation display, while it has a disadvantage of its difficulty to produce low power consumption.

And demands for multi-color production and animation display are intensifying in recent years with respect to mobile electronic equipment such as a mobile phone so s to provide high quality images. Consequently, in lieu of the liquid crystal panel of the simple matrix method, the liquid crystal panel of the active matrix method is being used now.

Now, in the liquid crystal panel of the active matrix method, it is desirable to set up an operational amplifier functioning as an output buffer inside a data driver which drives a data line of the liquid crystal panel. The operational amplifier has a high driving capacity capable of supplying voltage stably to the data line.

By the way, as multiple gray scales continue to obtain high quality of displayed images, it becomes necessary to increase the number of gray scale levels. In this case, a gray scale voltage corresponding to a gray scale value must be generated within a preset range of voltage.

However, the operational amplifier drives the data line based on the gray scale voltage corresponding to the gray scale value. As a result, it is possible to prevent quality of display from deteriorating by supplying a generated gray scale voltage to an arithmetic amplifier without lowering it.

For example, in the data driver, it is designed such that a DAC (voltage generating circuit in a broad sense) selectively outputs the gray scale voltage corresponding to the gray scale value out of a plurality of gray scale voltages. Accordingly, it is desirable that a path through which the gray scale voltage outputted by the DAC passes be of low impedance.

The present invention has been made in view of the above-mentioned technical problem, and it is an object thereof to provide a voltage generating circuit, a data driver, and a display unit which can output a generated voltage corresponding to digital data while suppressing a voltage drop thereof out of the plurality of generated voltages.

SUMMARY

To resolve the above-mentioned problem, the present invention relates to a voltage generating circuit which outputs a generated voltage corresponding to (a+b+c) bits of digital data (where a, b, and c are positive integers) from a plurality of generated voltages and which is constituted by a first conductive type MOS transistor, comprising: a first selector of a first conductive type outputting any generated voltage selected corresponding to low order bits of the digital that include the (b+c) bits, based on upper order bits of the digital data that include the a bits; $n^a$ pieces of second selectors of the first conductive type, each second selector being constituted by the first conductive type MOS transistor, and each second selector outputting any generated voltage of the plurality of generated voltages, based on the low order bits of the digital data, to the first selector of the first conductive type; the first selector of the second conductive type outputting any generated voltage selected corresponding to the low order bits of the digital data based on the upper order bits of the digital data; and $n^a$ pieces of second selectors of the second conductive type, each second selector being constituted by the second conductive type MOS transistor, and each second selector outputting any generated voltage of the plurality of generated voltages, based on the low order bits of the digital data, to the first selector of the second conductive type, wherein: there is related a voltage generating circuit which outputs a generated voltage corresponding to the digital data of the bits of the digital data from a node in which an output of the first selector of the first conductive type and an output of the first selector of the second conductive type are connected.

According to the present invention, by comparison to a case of constituting a decoder with a so-called ROM, it is possible to decrease a number of transistors through which a path for the generated voltage selected by the decoder to be supplied runs, and a voltage drop of the selected generated voltage may be reduced.

Further, in the voltage generating circuit according to the present invention, the first selector of the first conductive type has a plurality of first conductive type MOS transistors, on a gate of each which a gate signal corresponding to the a-bit data of the digital data is impressed, and one drain of the each which is electrically connected to the other drains;

the first selector of the second conductive type has a plurality of second conductive type MOS transistors, on a gate of each of which a gate signal corresponding to the a-bit data of the digital data is impressed, and one drain of the each of which is electrically connected to the other drains;

the second selector of the first conductive type has a plurality of first conductive type MOS transistors, on a gate of each which the gate signal corresponding to the b-bit data of the digital data is impressed, and one drain of the each of which is electrically connected to the others;

a node, in which one drain of the each first conductive type MOS transistor constituting the second selector of the first conductive type is electrically connected to the other drains, is electrically connected to any of the sources of the first conductive type MOS transistors constituting the first selector of the first conductive type;

the second selector of the second conductive type has a plurality of second conductive type MOS transistors, on a gate of each which the gate signal corresponding to the b-bit data of the digital data is impressed, and one drain of the each of which is electrically connected to the other drains;

a node, in which one drain of the each second conductive type MOS transistor constituting the second selector of the second conductive type is electrically connected to the other drains, is electrically connected to any of the sources of the second conductive type MOS transistors constituting the first selector of the second conductive type; and one drain and the other drains of the first conductive type MOS transistors constituting the first selector of the first conductive type may be electrically connected to one drain and the other drains of the second conductive type MOS transistors constituting the first selector of the second conductive type.

In the present invention, for each conductive type, a selector constituted by a transmission gate (path gate) is provided, so that an output of the first selector of one conductive type is compensated for by an output of the second selector of the other conductive type. This enables a drop portion of a threshold voltage of each transmission gate at the generating voltage to be compensated for and the number of transistors, through which the supply path of the selected generating voltage runs, to be decreased.

Further, in a voltage generating circuit according to the present invention, each first conductive type MOS transistor constituting the $2^a$ pieces of the second selector of the first conductive type is placed in a direction intersecting a channel width direction of each first conductive type MOS transistor constituting the first selector of the first conductive type, a channel width direction of each first conductive type MOS transistor constituting the first and the second selectors of the first conductive type is parallel, and an on resistance of each first conductive type MOS transistor constituting the first selector of the p may be less than an on resistance of each first conductive type MOS transistor constituting the second selector of the first conductive type.

In the present invention, the selective path of the generated voltage runs with certainty through the first conductive type MOS transistor constituting the first selector. Hence, lowering the on resistance of the MOS transistor makes it possible to prevent the voltage effectively from dropping.

Further, in a voltage generating circuit according to the present invention, the channel width of a channel of each first conductive type MOS transistor constituting the first selector of the first conductive type may be larger than the channel of each first conductive type MOS transistor constituting the second selector of the first conductive type.

According to the present invention, since the number of the first selectors is fewer than the number of the second selectors, without making a layout assigned area wastefully large, it is possible to make a channel width of the MOS transistor constituting the first selector larger than a channel width of the MOS transistor constituting the second selector. Consequently, it is possible to lower the on resistance of the MOS transistor constituting the first selector through which the selective path of the generating voltage passes with certainty, so that the voltage drop may be prevented effectively.

Further, in a voltage generating circuit according to the present invention, the above-mentioned digital data is gray scale data and the above-mentioned generated voltage maybe a gray scale voltage.

Still further, the present invention relates to a data driver which drives a plurality of data lines of an electro-optical device including a plurality of scanning lines and the plurality of data lines based on the digital data, and which includes the voltage generating circuit mentioned above and a drive circuit driving data lines based on a gray scale voltage outputted by the above-mentioned voltage generating circuit.

According to the present invention, the voltage drop of the gray scale voltage may be prevented, so that deterioration of the displayed quality may be prevented.

Further, the present invention relates to a display unit including a plurality of scanning lines, a plurality of data lines, a plurality of switching elements, each of which is connected to each scanning line and each data line, a scanning driver scanning the above-mentioned plurality of scanning lines, and the above-mentioned data driver driving the above-mentioned plurality of data lines.

According to the present invention, a display unit capable of preventing deterioration of the displayed quality due to the voltage drop of the gray scale voltage can be provided.

DETAILED DESCRIPTION

An embodiment according to the present invention will be described below with reference to the drawings. It should be noted that the embodiment to be described below does not limit unjustly the content of the present invention described in the claims. Further, all the configuration described below is not necessarily the essential composing elements of the present invention.

1. Display Unit

Figure 1:
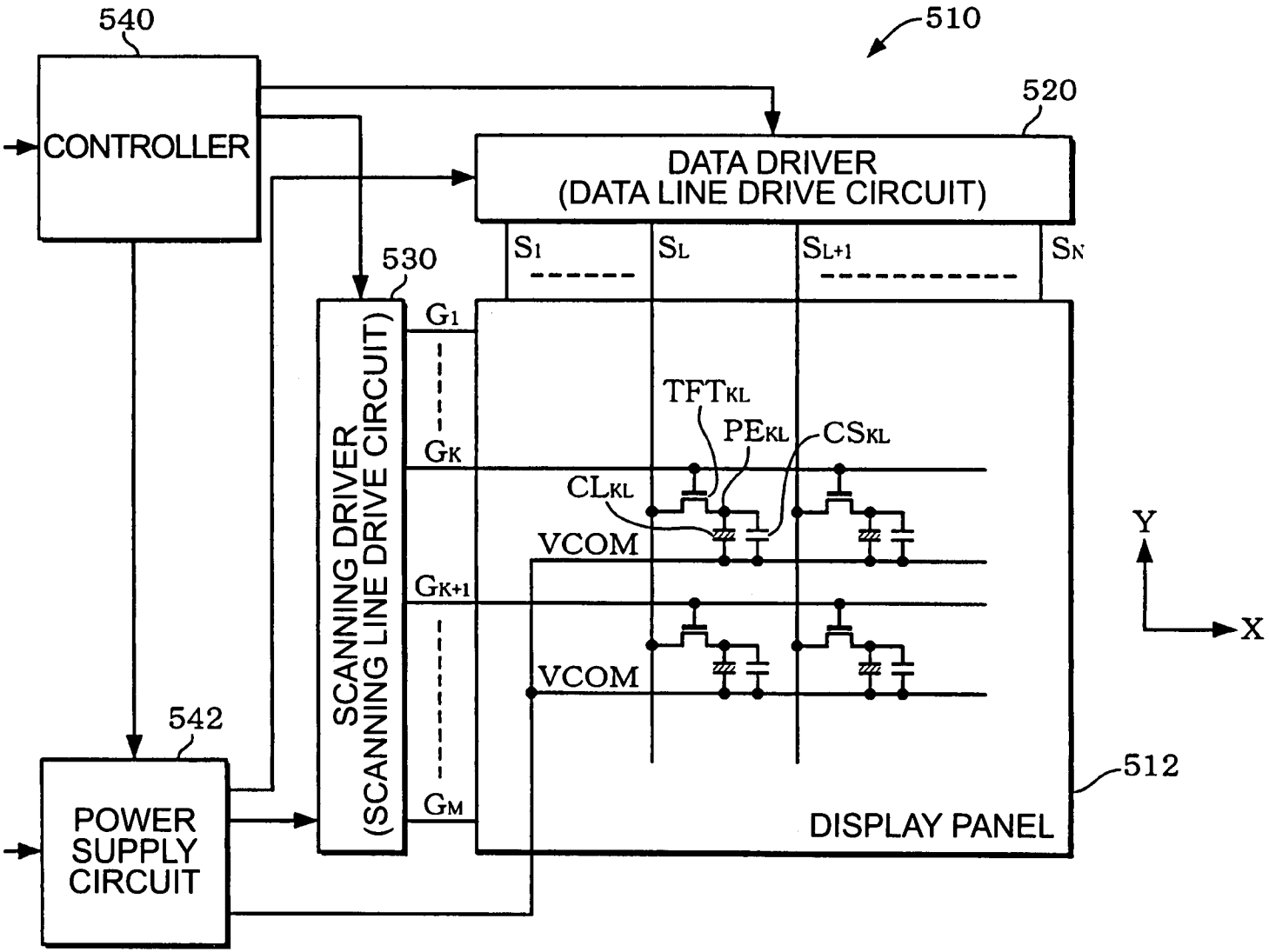
FIG. 1 is an example of a block diagram of a display unit of the present embodiment.

An example of a block diagram of a display unit of the present embodiment is shown in FIG. 1.

This display unit 510 is a liquid crystal unit. The display unit 510 comprises a display panel 512 (in a narrow sense, Liquid Crystal Display: LCD) panel), a data driver (data line drive circuit) 520, a scanning driver (scanning line drive circuit), a controller 540, and a power circuit 542. It should be noted that it is not necessary for the display unit 510 to include all these circuits and that a configuration omitting part of the circuit block may be used.

The display panel 512 (in a broad sense, an electro-optical device) herein comprises a plurality of scanning lines (in a narrow sense, gate lines), a plurality of data lines (in a narrow sense, source lines), and a pixel electrode specified by a scanning line and a data line. In this case, a thin film transistor TFT (in a broad sense, a switching element) is connected to the data line, and by connecting the pixel electrode to this TFT, a liquid crystal unit of active matrix type may be configured.

To be more specific, the display panel 512 is formed on an active matrix substrate (for example, a glass substrate). On this active matrix substrate, there are placed scanning lines $G_1$-$G_M$ (M is an natural number over 2), a plurality of which are arrayed in y-direction of FIG. 1 and which extend respectively in x-direction and data lines $S_1$-$S_N$ (N is an natural number over 2), a plurality of which are arrayed in the x-direction and which extend respectively in the y-direction. Further, at a position corresponding to an intersecting point of the scanning line $G_K$ ($1 \leqq K \leqq M$, where K is a natural number) and the data line $S_L$ ($1 \leqq L \leqq N$, where L is a natural number), there is set up a thin film transistor $TFT_{KL}$ (in a broad sense, a switching element).

A gate electrode of the $TFT_{KL}$ is connected to a scanning $TFT_{KL}$ a source electrode of the $TFT_{KL}$ is connected to a data line $S_L$, and a drain electrode of the $TFT_{KL}$ is connected to a pixel electrode $PE_{KL}$. A liquid crystal capacity $CL_{KL}$ (liquid crystal device) and a subsidiary capacity $CS_{KL}$ are formed between this pixel electrode $PE_{KL}$ and an opposite electrode (common electrode) VCOM with the pixel electrode $PE_{KL}$ and a liquid crystal device (in abroad sense, an electro-optical substance) held therebetween. And a liquid crystal is sealed in between the active matrix substrate, in which the $TFT_{KL}$, the pixel electrode $PE_{KL}$, and the like are formed, and an opposite substrate in which the opposite electrode VCOM is formed, so that a transmission factor of the pixel may change corresponding to an impressed voltage between the pixel electrode $PE_{KL}$ and the opposite electrode VCOM.

It should be noted that a common voltage given to the opposite electrode VCOM is generated by the power circuit 542. Further, it may be such that no methodion is made over the entire surface of the opposite electrode VCOM but in a stripe to match each scanning line.

The data driver 520 drives the data lines $S_1$-$S_N$ of the display panel 512 based on the gray scale data. On the other hand, a scanning driver 530 sequentially scans the scanning lines $G_1$-$G_M$ of the display panel 512.

The controller 540 controls the data driver 520, the scanning driver 530, and the power circuit 542 according to a content set by a host such as the un-illustrated Central Processing Unit (hereinafter referred to as CPU).

To be more specific, the controller 540 supplies to the data driver 520 and the scanning driver 530, for example, a vertical synchronous signal and a horizontal synchronous signal generated by setting operating mode and internally, while controlling polarity reversing timing of the common voltage of the opposite electrode VCOM with respect to the power circuit 542.

The power circuit 542, based on the reference voltage externally supplied, generated various voltages necessary for driving the display panel 512 and the common voltage of the opposite electrode VCOM.

Now, in FIG. 1, the display unit 510 is configured such as to include the controller 540, whereas the controller 540 may be provided outside the display unit 510. Or, it may be configured such that the host is included in the display unit 510, together with the controller 540. Or, part or all of the data driver 520, the scanning driver 530, the controller 540, and the power circuit 542 may be formed on the display panel 12.

1.1 Data Line Drive Circuit

Figure 2:
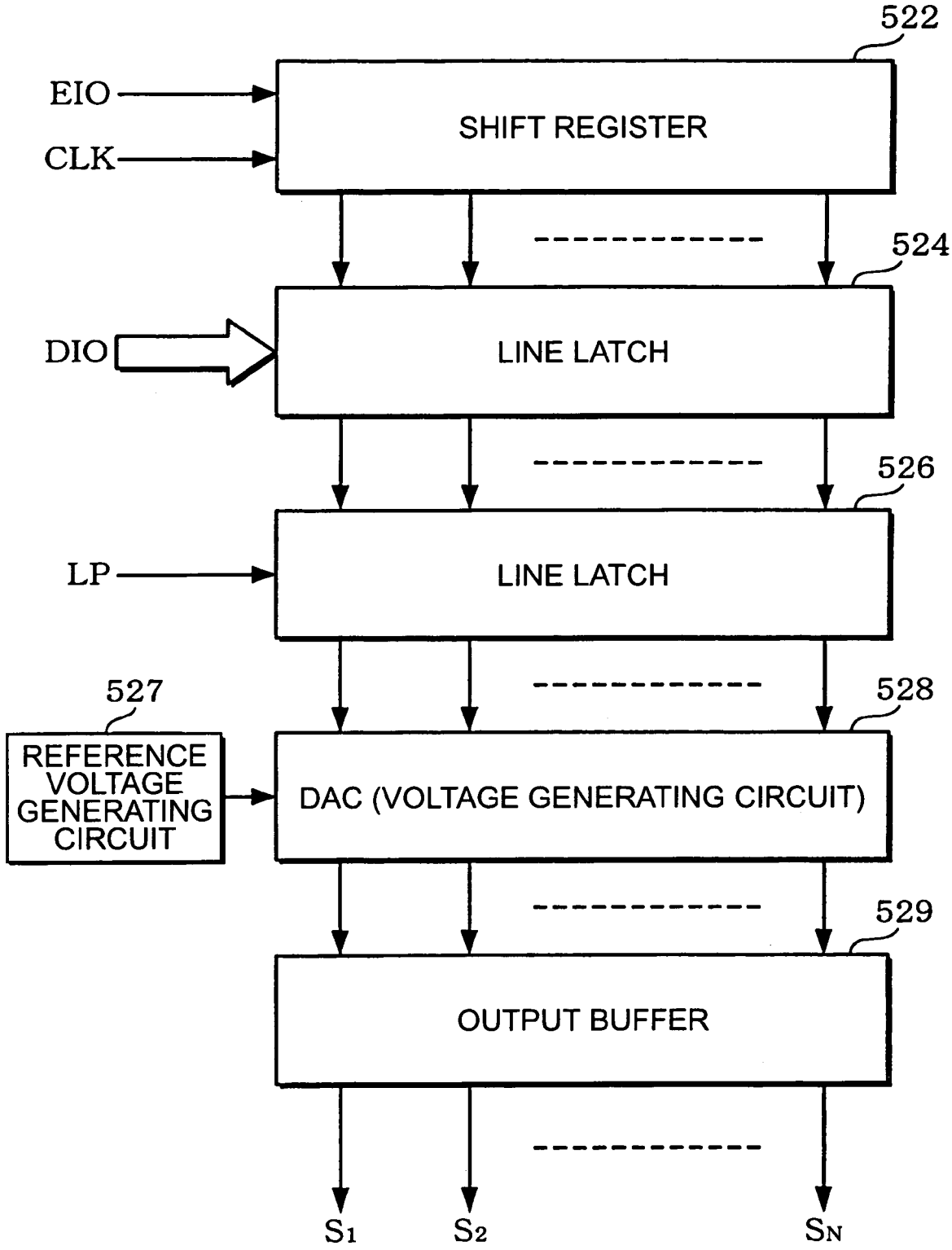
FIG. 2 is a diagram showing a configuration example of FIG. 1.

In FIG. 2, a configuration example of the data driver 520 of FIG. 1 is shown.

The data driver 520 includes a shift register 522, line latches 524 and 526, a reference voltage generating circuit 527, a DAC 528 (digital analog conversion circuit, in a broad sense, a voltage generating circuit), and an output buffer 529.

The shift register 522 is set up corresponding to each data line and includes a plurality of flip-flops which are sequentially connected. This shift register 522, when holding an enable input/output signal EIO synchronously with a clock signal CLK, shifts the enable input/output signal EIO to the adjacent flip-flop synchronously with the clock signal CLK sequentially.

To the line latch 534, there is inputted gray scale data (DIO)(in a broad sense, digital data) in a unit of 18 bits (6 bits (gray scale data)×3 (each color of RGB)). The line latch 524 latches this gray scale data (DIO) synchronously with the enable input/output signal EIO sequentially shifted by each flip-flop of the shift register 22.

The line latch 526 latches gray scale data of one horizontal scanning unit latched by the line latch 524 synchronously with a horizontal synchronizing signal LP supplied from the controller 540.

The reference voltage generating circuit 527 generates a plurality of reference voltages (gray scale voltage, generated voltage) in which each reference voltage (in a narrow sense, gray scale voltage; in a broad sense, generated voltage) corresponds to each gray scale data. The reference voltage generating circuit 527 includes a gamma correction resistance, and outputs as a gray scale voltage (generated voltage) a divided voltage which is obtained by dividing a voltage on both ends of the gamma correction resistance through resistance division. Hence, by changing a resistance rate of the resistance division, it is possible to adjust the gray scale voltage corresponding to the gray scale data, thus realizing "so-called" gamma correction.

The DAC 528 generates an analog data voltage to be supplied to each data line. Specifically, the DAC selects, based on the digital gray scale data (digital data) from the line latch 528, any gray scale voltage (generated voltage) from a plurality of gray scale voltages (generated voltages) generated by the reference voltage generating circuit 527, and outputs it as an analog data voltage corresponding to the digital gray scale data (digital data).

An output buffer 529 buffers, outputs a data voltage from the DAC 528 to the data line, and drives the data line. Specifically, the output buffer 529 includes an arithmetic amplifier (operational amplifier) of a voltage follower connection set up per data line, whereas each of these arithmetic amplifiers subjects the data voltage from the DAC 528 to impedance conversion and outputs it to each data line.

1.2 Scanning Driver

Figure 3:
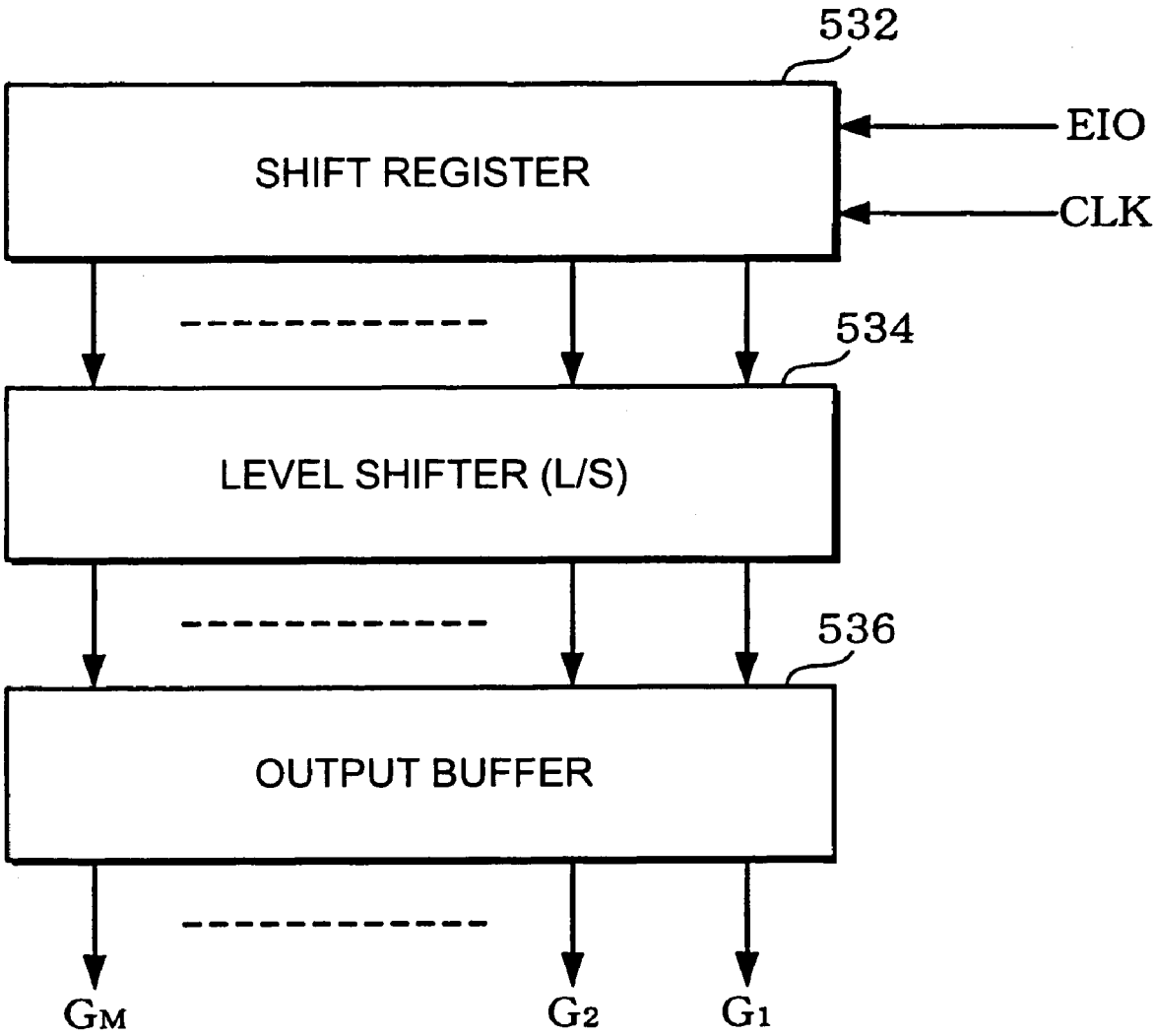
FIG. 3 is a diagram showing a configuration example of a scanning driver of FIG. 1.

In FIG. 3, a configuration example of a scanning driver 530 is shown.

The scanning driver 530 includes a shift register 532, a level shifter 534, and an output buffer 536.

The shift register 532 is set up corresponding to each scanning line and includes a plurality of flip-flops sequentially connected. This shift register 532, when holding an enable input/output EIO in the flip-flop synchronously with the clock signal CLK, sequentially synchronizes with the clock signal CLK and shifts the enable input/output EIO to this adjacent flip-flop. The enable input/output EIO inputted at this point is a vertical synchronizing signal supplied from the controller 540.

The level shifter 534 shifts a voltage level from the shift register 532 to a voltage level corresponding to a liquid crystal device of the display panel 512 and transistor capacity of the TFT. As the voltage level, for example, a high voltage level of 20V-50V will be needed.

The output buffer 536 buffers a scanning voltage shifted by the level shifter 534, outputs it to a scanning line, and drives the scanning line.

2. Detailed Description of Data Driver

In the present embodiment, it is possible to clear away, in a simple configuration, deterioration of displayed quality which accompanies a scattering of an output voltage of an arithmetic amplifier set up at each data line in the output buffer 529.

Figure 4:
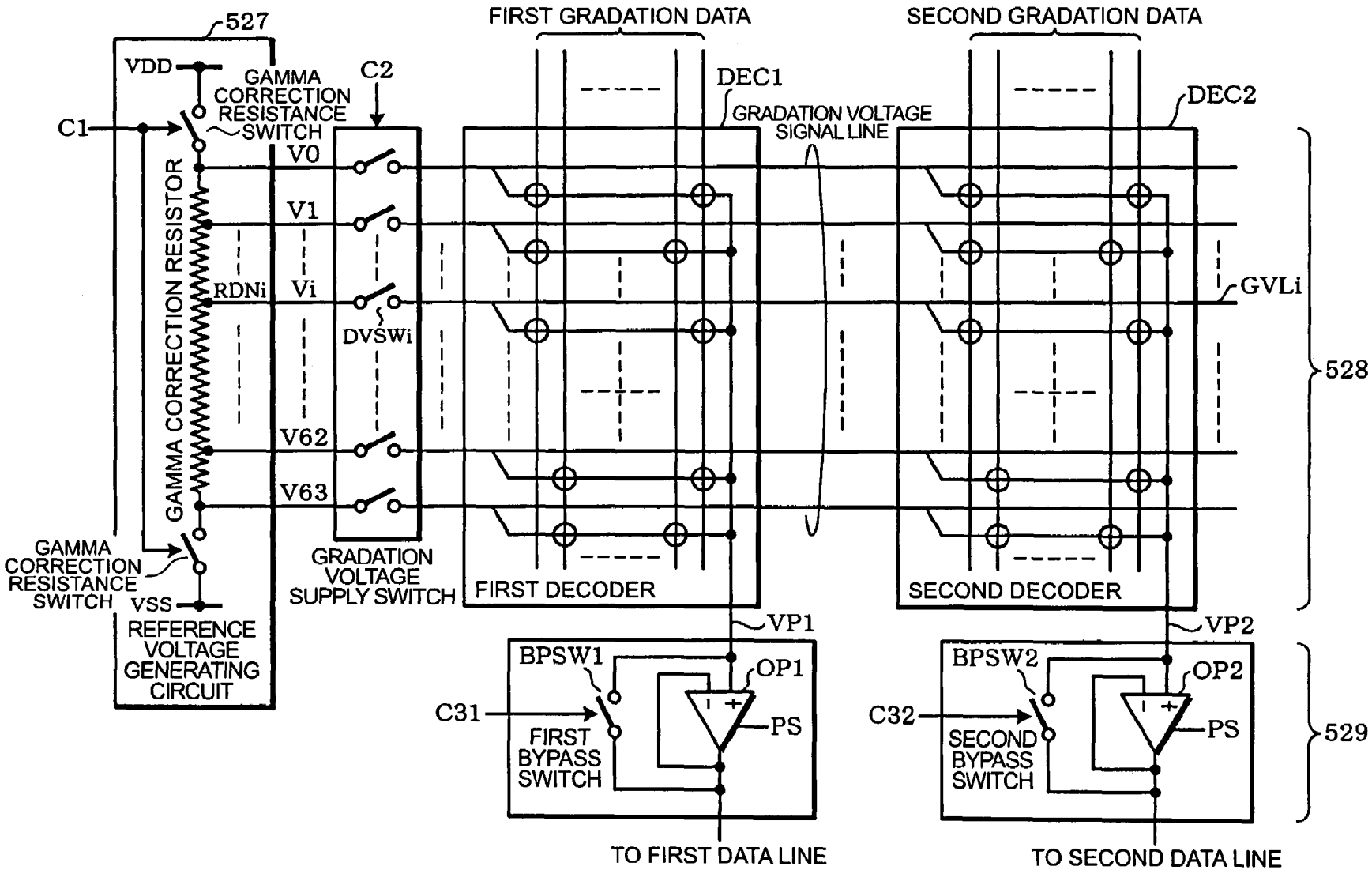
FIG. 4 is a diagram showing a configuration example of the principal part of a data driver in the present embodiment.

In FIG. 4, a configuration example of a principal part of the data driver in the present embodiment is shown. However, the same reference numerals are given to the same parts of the data driver 520 shown in FIG. 2 with explanation omitted as appropriate.

In FIG. 4, there are shown drive portions of two data lines (first and second data lines) out of the data lines $S_1$-$S_N$ of the display panel 512. Further, the gray scale data for each data line is set in 6 bits and the gray scale level is set as 64 ($=2^6$).

The reference voltage generating voltage 527 includes a gamma correction resistance. The gamma correction resistance outputs a split voltage Vi ($0 \leqq i \leqq 63$, where i is an integer), which is a voltage between a system power voltage VDD (first power voltage) and a system ground power voltage VSS (second power voltage) subjected to resistance split, as a gray scale voltage Vi, to a resistance split node RDNi.

In a gray scale voltage signal line GVLi, the gray scale voltage Vi is supplied. To be more specific, a gray scale voltage supply switch DVSWi is installed between the resistance split node RDNi and the gray scale voltage supply line GVLi. And when the gray scale voltage supply switch DVSWi is in the continuity state, the gray scale voltage Vi is supplied to the gray scale voltage supply line GVLi. Further, when the gray scale voltage supply switch DVSWi is in the shut off state, the gray scale voltage supply line GVLi and the resistance split node RDNi are electrically cut off.

In the output buffer 529, there are included a first operational amplifier OP1 set up to correspond to the first data line and a second operational amplifier OP2 set up to correspond to the second data line. The first and the second operational amplifiers OP1 and OP2 are of the same configuration. And, when the gray scale data for each operational amplifier is the same data, inputs of the first and the second operational amplifiers OP1 and OP2 are connected electrically to the gray scale voltage supply line GVLi.

Connection of an input of such first operational amplifier OP1 is carried out by a first decoder (voltage generating circuit) DEC1 set up to correspond to the first operational amplifier OP1. The first decoder DEC1 electrically connects one gray scale voltage signal line from among a plurality of gray scale voltage signal lines to the input of the first operational amplifier OP1, based on the first gray scale data OP1 corresponding to the first operational amplifier OP1.

Likewise, connection of an input of the above-mentioned second operational amplifier OP2 is carried out by a second decoder (voltage generating circuit) DEC2 set up to correspond to the second operational amplifier OP2. The second decoder DEC2 electrically connects one gray scale voltage signal line from among a plurality of gray scale voltage signal lines to the input of the second operational amplifier OP2, based on the second gray scale data OP2 corresponding to the second operational amplifier OP2.

The first and the second decoders DEC1 and DEC2 have the same configuration, and when gray scale data to be inputted is the same data, the same gray scale voltage signal line is connected to the inputs of the first and the second operational amplifiers OP1 and OP2.

Further, in the output buffer 529, a first bypass switch BPSW1 is set up between the input and the output of the first operational amplifier OP1, bypassing the first operational amplifier OP1. A second bypass switch BPSW2 is set up between the input and the output of the second operational amplifier OP2, bypassing the second operational amplifier OP2.

It should be noted that the reference voltage generating circuit 527 may include a gamma correction resistance switch. One end of the gamma correction switch is supplied with the system power voltage VDD or the system ground power voltage VSS, while the other end thereof is connected to one end of the gamma correction resistance. The gamma correction resistance switch is set by a control signal C1 to be in the continuity state or in the shut off state.

Gray scale voltage supply switches DVSW0-DVSW63 are set all at once by a control signal C2 to be in the continuity state or in the shut off state. Further, the first bypass switch BPSW1 is set by a control signal C31 to be in the continuity state or in the shut off state. The second bypass switch BPSW2 is set by a control signal C32 to be in the continuity state or in the shut off state. The control signals C31 and C32 may be made the same signal.

Figure 5:
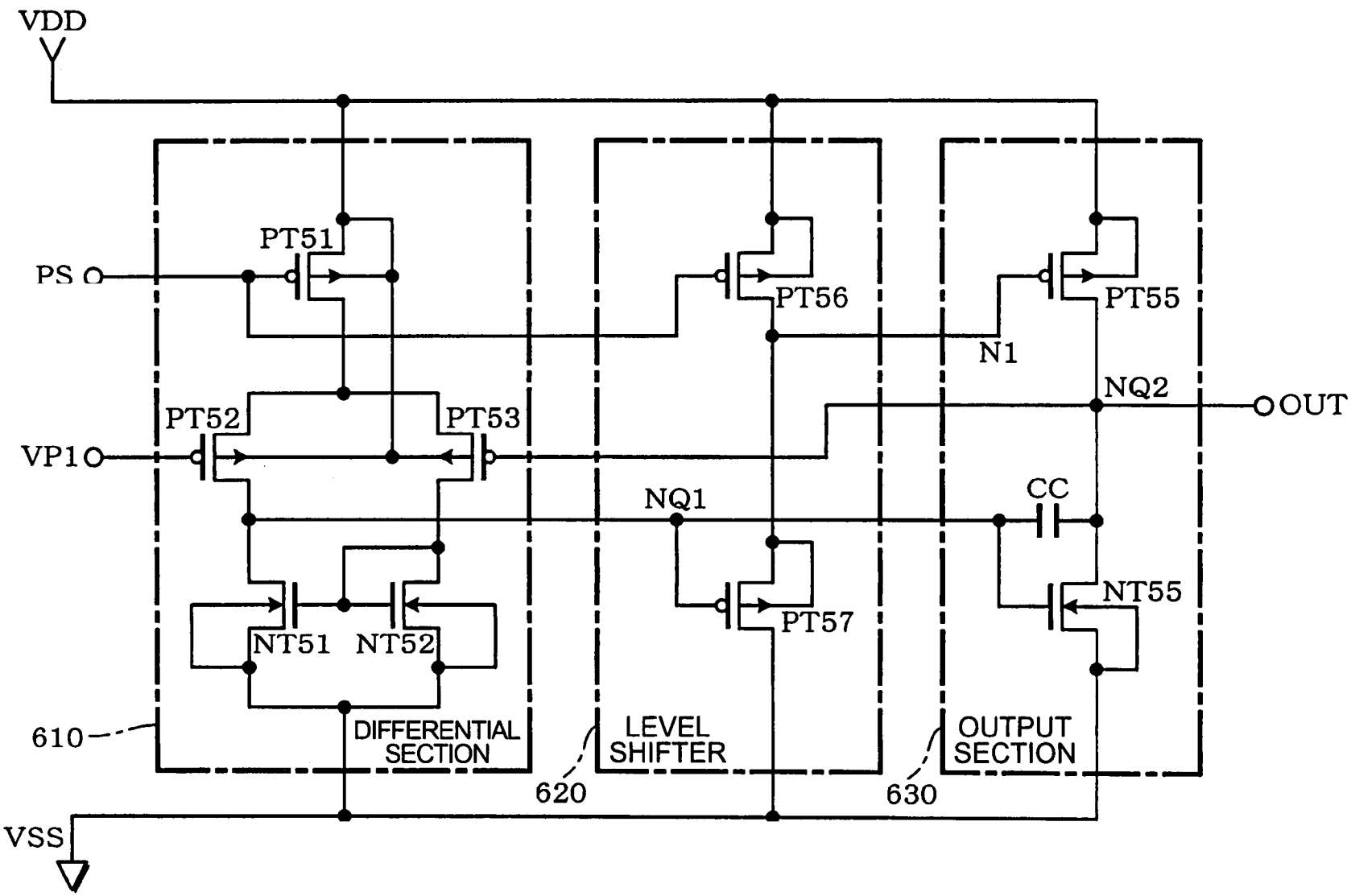
FIG. 5 is a circuit diagram of a configuration example of a first operational amplifier of FIG. 4.

In FIG. 5, there is shown a circuit diagram of a configuration example of the first operational amplifier OP1. The configuration of the first operational amplifier OP1 is shown in FIG. 5, whereas a configuration of the second operational amplifier is the same.

As the first operational amplifier OP1, for example, an arithmetic amplifier (push-pull type) of AB class of a configuration shown in FIG. 5 may be used. This arithmetic amplifier of the AB class includes a differential section 60, a level shifter 620, and an output section 630.

The differential section 610 amplifies a differential value of a differential signal (VP1, OUT). The level shifter 620 carries out a level shift of a voltage of an output node NQ1 of the differential section 610 and outputs it to a node N1. The level shifter 620 operates with a drain current (operation current) running in a p-type transistor PT56 as a current source.

The output section 630 comprises a p-type drive transistor PT55, whose gate electrode is connected to the node NQ1, an n-type drive transistor NT55, whose gate electrode is connected to the node NQ1, and a capacity element CC for phase compensation.

In this arithmetic amplifier, a node NQ2 of the output section 630 is connected to a gate electrode of a p-type transistor PT53 of the differential section 610 such as to be in a state whereby a voltage follower connection is formed. The arithmetic amplifier with the voltage follower connection can increase input impedance and decrease output impedance, thus making it possible to supply a stable voltage.

The first operational amplifier OP1 is designed such that by means of a power save signal PS, drain currents (operating current) of p-type transistors PT 51 and PT 56 may be limited or stopped. At this instant, the output of the first operational amplifier OP1 is set to a state of high impedance.

Figure 6:
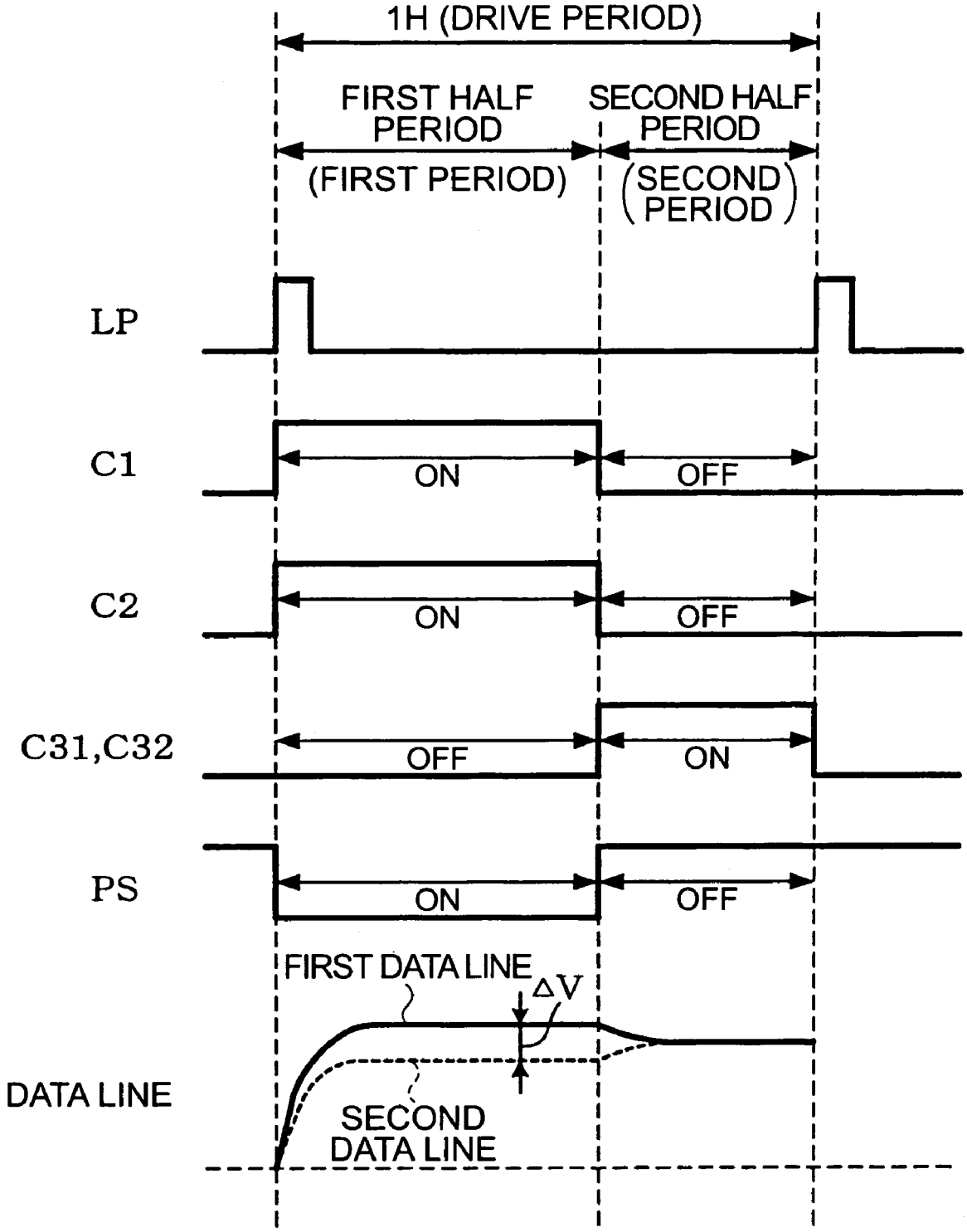
FIG. 6 is a timing diagram to explain an operating example of a data driver of FIG. 4.

In FIG. 6, there is shown a timing diagram to explain an operation example of the data driver shown in FIG. 4.

At this point, the first and the second gray scale data are assumed to be the same, whereupon in a horizontal scanning period (in a broad sense, drive period) stipulated by the horizontal synchronizing signal LP, the first and the second operational amplifiers OP1 and OP2 drive the first and the second data lines based on the gray scale voltage corresponding to the first and the second gray scale data.

In the present embodiment, a first period T1 and a second period T2 are established (1H≧T1+T2) within the horizontal scanning period. The second period T2 is acceptable as long as it is a period following the first period T1 and a period within the horizontal scanning period. Further, it is possible to divide the horizontal scanning period simply into two periods, the first half period being the first period T1 and the last half period being the second period T2.

In the first period T1, the gamma correction resistance switch is set in the continuity state by the control signal C2. Also, the gray scale voltage supply switches DVSW0-DVSW63 are set in the continuity state by the control signal C2. Further, by means of the control signals C31 and C32, the first and the second bypass switches BPSW1 and BPSW2 are set in the shut off state. Still further, by a power save signal PS, the first and the second operational amplifier OP1 and OP2 are set in the operational state.

In the first period T1, the same gray scale voltage (Vi) is supplied for the inputs of the first and the second operational amplifiers OP1 and OP2. Consequently, by the first and the second operational amplifiers OP1 and OP2, based on the gray scale voltage Vi, the first and the second data lines are driven. As a result, the first and the second data lines are supposed to be of the same potential. And yet, resulting from a scattering and the like of the threshold voltages of transistors constituting the first and the second operational amplifiers OP1 and OP2, the output voltages of the first and the second operational amplifiers OP1 and OP2 are different, and, for example, as shown in FIG. 6, a potential difference ΔV is produced.

In the following second period T2, the gamma correction resistance switch is set in the shut off state by the control signal C2. Also, the gray scale voltage supply switches DVSW0-DVSW63 are set in the shut off state by the control signal C2. Further, by means of the control signals C31 and C32, the first and the second bypass switches BPSW1 and BPSW2 are set in the continuity state. Still further, by the power save signal PS, the first and the second operational amplifier OP1 and OP2 are set in the halt state, and the outputs of the first and the second operational amplifier OP1 and OP2 are set in the high impedance state.

In this second period T2, the same gray scale voltage (Vi) is supplied for the inputs of the first and the second operational amplifiers OP1 and OP2. Consequently, the first and the second data lines are electrically connected through the gray scale voltage signal line GVLi, the first and the second bypass switches BPSW1 and BPSW2, according to a path P1 shown in FIG. 7. As a result, as shown in FIG. 6, potentials of the first and the second data lines become equal.

By doing so, even if there is a scattering of the output voltages of the first and the second operational amplifiers OP1 and OP, with a simple configuration, they can be made equal to the potentials of the first and the second data lines. By focusing on each data line, even though it may not be the original data voltage, the deterioration of the display quality may be evaluated over the entire screen, so that once a relative divergence is cleared away, the deterioration of the display quality can be prevented.

Also, in the second period, it is designed such that operating currents of the first and the second operational amplifiers OP1 and OP2 may be limited or stopped, hence, a period in which the first and the second operational amplifiers OP1 and OP2 can operate within a drive period can be made short and current consumption can also be reduced.

Further, in the second period T2, it is designed such that the gamma correction resistance switch is set in the shut off state. By doing so, in the second period T2 in which the gray scale voltage that the gamma correction resistance outputs is wasted, wasteful current consumption running to the gamma correction resistance can be reduced. Further, in the second period T2, since gray scale supply switches are put into the shut off state all at once, it is possible to prevent a plurality of gray scale voltage signal lines from being electrically connected through the gamma correction resistance, thus enabling charges, which are charged as a gray scale voltage Vi is supplied, to be shared by the first and the second data lines.

It should be noted that while, in the present embodiment, by limiting or stopping the operating currents of the first and the second operational amplifiers OP1 and OP2, the outputs of the first and the second operational amplifiers OP1 and OP2 may be set in the high impedance state, it is not limited by it. By setting up a switching element between each output of the operational amplifier and each data line, in the second period T2, it is possible, for example, to cut off electrically the outputs of the first and the second operational amplifiers OP1 and OP2 and the first and the second data lines.

3. Data Voltage Generating Circuit of the Present Embodiment

Figure 7:
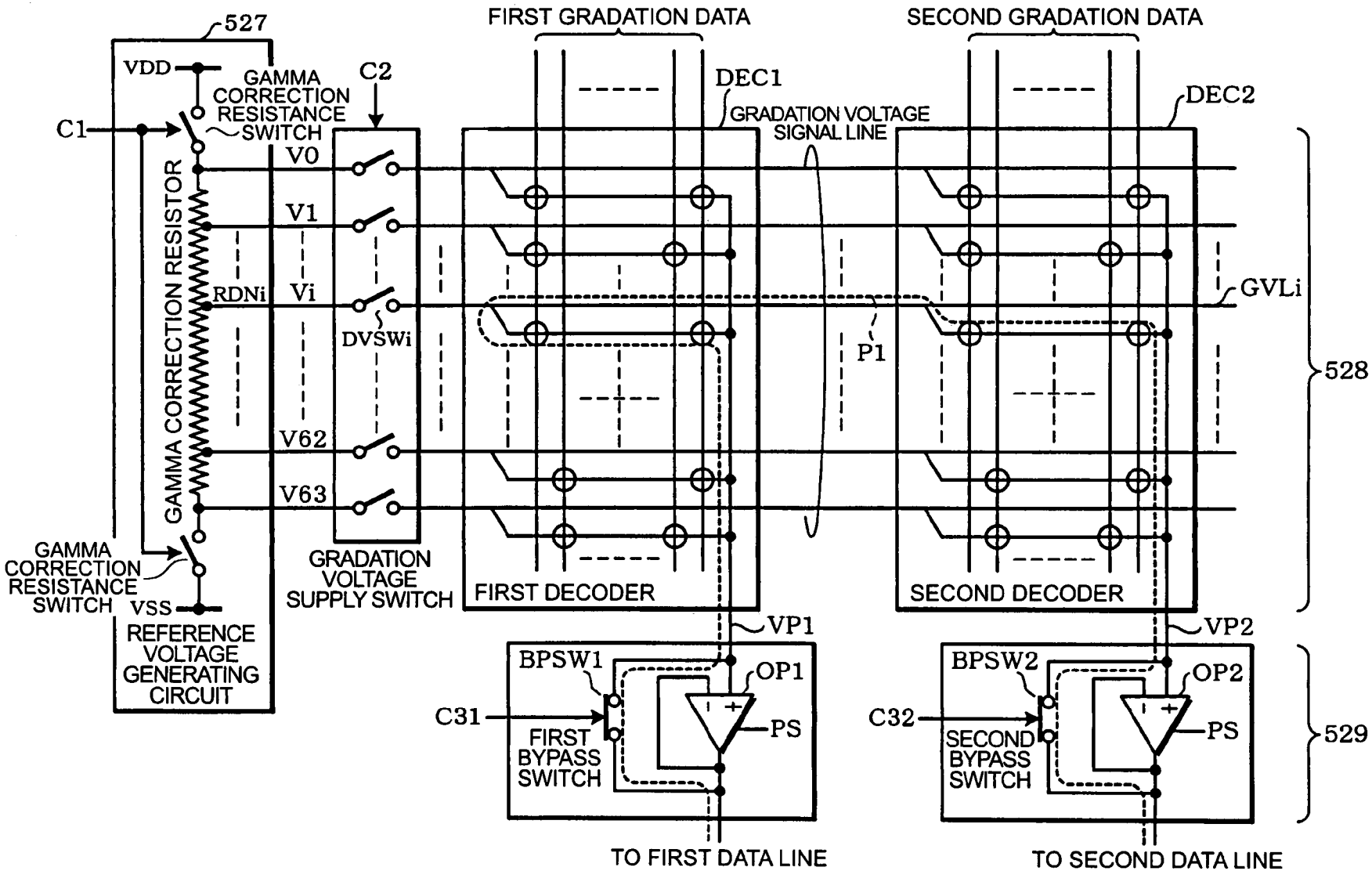
FIG. 7 is an explanatory diagram of connection paths of inputs to a first and a second operational amplifiers.

In the present embodiment, by means of the path P1 shown in FIG. 7, the first and the second data lines are electrically connected, so that making the path P1 of the first and the second decoders DEC1 and DEC2 in low impedance is effective. This is because when the impedance of the path P1 of the first and the second decoders DEC1 and DEC2 is high, a voltage drop occurs inside the first and the second decoders DEC1 and DEC2, whereas the potentials of the first and the second data lines in the second period 2 largely diminishes from the original voltage which is supposed to be supplied corresponding to the gray scale data.

Figure 8A:
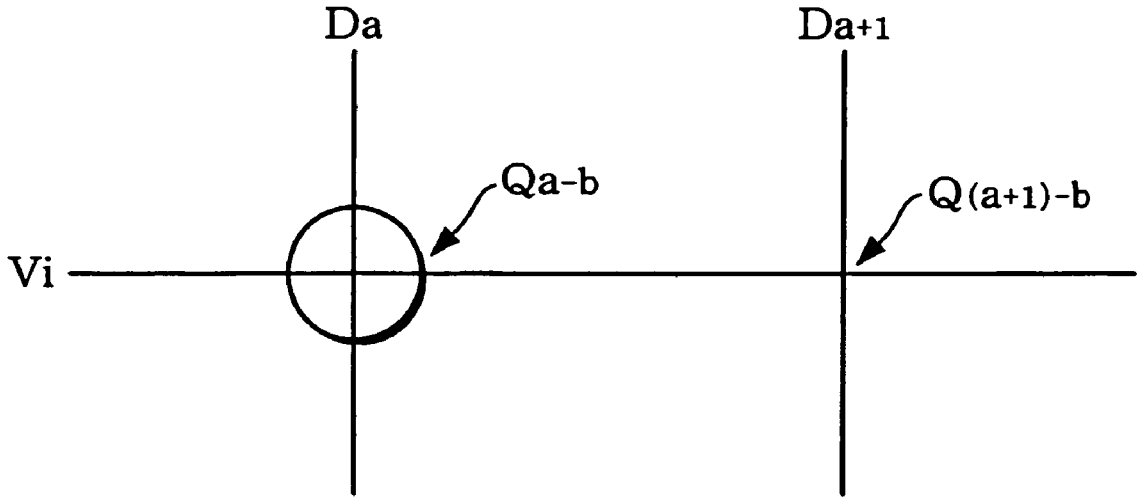
FIGS. 8A and B are explanatory diagrams of configuration examples of conventional first and second decoders.

Explanatory diagrams of configuration examples of the conventional first and the second decoders DEC1 and DEC2 are shown in FIGS. 8A and B. In FIG. 8A, there is shown an example of the first and the second decoders DEC1 constituted by a so-called ROM (Read Only Memory). In this case, at an intersecting position of the gray scale voltage signal line GVLi, to which the gray scale voltage Vi is supplied, and a 1-bit data line Da of the gray scale data, there is installed a transistor Qa-b.

Figure 8B:
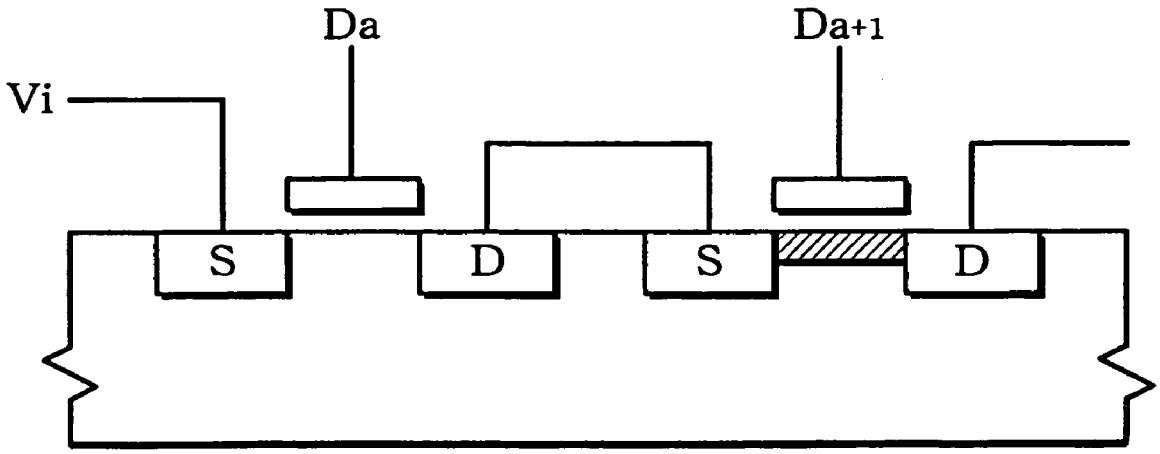

Actually, at an intersecting position of the gray scale voltage signal line GVLi and a 1-bit data line Da+1 of the gray scale data, too, there is installed a transistor Q(a+1)-b. And, as shown in FIG. 8B, a channel area of the transistor Q(a+1)-b is formed by ion implantation such that the channel area is in the continuity state at all times. Consequently, the transistor Qa-b operates as a so-called switching element, and the transistor Q(a+b)-b becomes the switching element in the on state at all times.

This produces effects in which ROM data may be altered with only a so-called mask exchange and a layout area may also be reduced.

At this point, as shown in FIGS. 8A and B, consider a case of constituting each decoder of the first and the second decoders DEC1 and DEC2. If we assume that the first and the second gray scale data are 6 bits, a selective path of the gray scale voltage in each decoder will pass through a total of 12 pieces of transistors (a positive turn portion of each bit and an inverse turn portion of the gray scale data combined). Consequently, as in the present embodiment, in the path P1, the total of 24 pieces of transistors will be passed through, so that the on resistance of each transistor cannot be ignored.

Accordingly, as explained below, by constituting the first and the second decoders DEC1 and DEC2, the number of transistors for the path, which is formed when the first and the second data lines are electrically connected, to pass through may be reduced.

Figure 9:
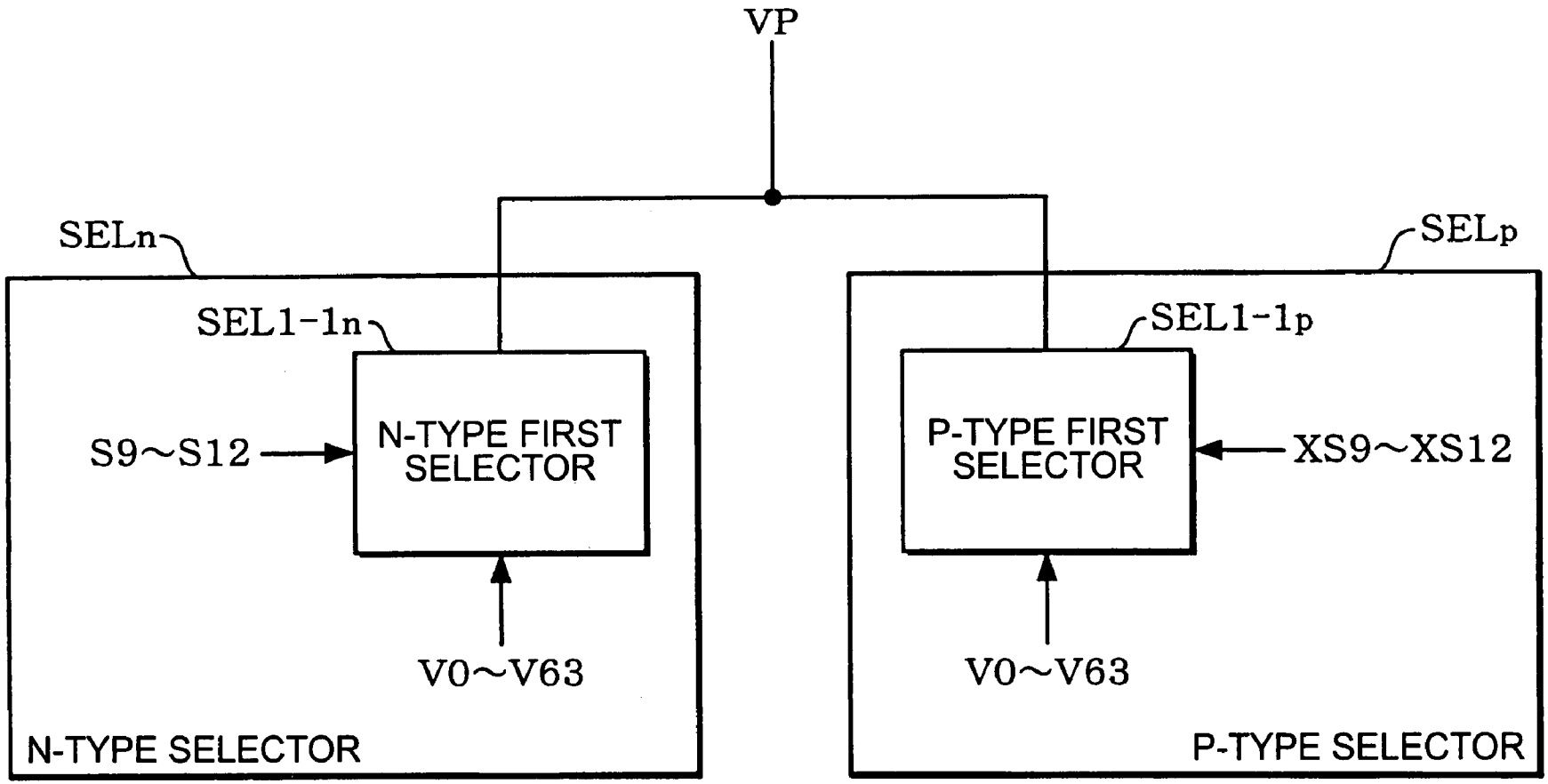
FIG. 9 is a diagram showing a configuration example of the first decoder in the present embodiment.

In FIG. 9, a configuration example of the first decoder DEC1 in the present embodiment is shown. In FIG. 9, the configuration of the first decoder DEC1 is shown, and the configuration of the second decoder DEC2 is the same.

The first decoder (in a broad sense, voltage generating circuit) DEC1, based on upper order a-bit data of the gray scale data (digital data) of (a+b+c)-bit (where a, b, and c are positive integers) gray scale data, electrically connects the gray scale voltage signal line (generated voltage signal line), to which any gray scale voltage of a plurality of gray scale voltages (generated voltage) selected corresponding to data of low order (b+c)-bit data of the gray scale data, to the inputs of the first and the second operational amplifier. In the following, description is provided assuming 2 for a, 2 for b, and 2 for c.

The first decoder DEC1 includes a p-type selector SELp and an n-type selector SSELn. The p-type selector SELp is constituted by a transmission gate of only a p-type MOS (Metal Oxide Semiconductor). The n-type selector SELp is constituted by a transmission gate of only an n-type MOS transistor.

Suppose that the p-type is considered a first conductive type, then the n-type can be a second conductive type, and suppose that the n-type is considered a first conductive type, then the p-type can be a second conductive type. The same applies to the following.

And, it may be said that the p-type selector SELp and the n-type selector SELp are in a complementary relationship. Namely, a voltage drop of a threshold voltage portion of the n-type MOS transistor generated at the transmission gate of only the n-type MOS transistor is complemented by an output of a transmission gate of the p-type MOS transistor. Also, the voltage drop of the threshold voltage portion of the p-type MOS transistor generated at the transmission gate of only the p-type MKOS transistor is complemented by the output of the transmission gate of only the n-type MOS transistor Such p-type selector SELp includes a p-type first selector SEL1-1*p*. The n-type selector SELn includes an n-type first selector SEL1-1*n*.

The p-type first selector SEL1-1*p* has a plurality of p-type MOS transistors in which a gate signal corresponding to a-bit data of the gray scale data is impressed on a gate of each p-type MOS transistor, and a drain of the each p-type MOS transistor is electrically connected between each other. In FIG. 9, a case where a is 2 is shown, and a gate signal x S9-XS12 are supplied to the gate of each p-type MOS transistor.

The first selector SEL1-1*n* of the n-type has a plurality of n-type MOS transistors in which a gate signal corresponding to a-bit data of the gray scale data is impressed on a gate of each n-type MOS transistor, and a drain of the each n-type MOS transistor is electrically connected between each other. In FIG. 9, a gate signal x S9-S12 are supplied to the gate of each n-type MOS transistor.

And, a connection node between drains of the each p-type MOS transistor constituting the p-type first selector SEL1-1*p* and a connection node between drains of the each n-type MOS transistor constituting the first selector SEL1-1*p* of the n-type are electrically connected. In the first decoder DEC1, any gray scale voltage of a plurality of gray scale voltages selected corresponding to the b+c bits of the gray scale data is supplied to a source of each MOS transistor of a plurality of MOS transistors constituting each first selector SEL1-1*p* and SEL1-1*n*. In FIG. 9, four gray scale voltages of a plurality of gray scale voltages V0-V63 selected corresponding to low order 4 bits of the gray scale data are inputted into each first selector SEL1-1*p*; and SEL1-1*n*.

In the present embodiment, a gate signal (S9-S12, XS9-XS12 in FIG. 9) of each MOS transistor is generated by a pre-decoder.

Through the foregoing configuration, the first decoder DEC1 reduces the number of transistors through which the electric path of the gray scale voltage selected by each first selector SEL1-1*p* and SEL1-1*n* passes.

A detailed configuration example of the first decoder DEC1 shown in FIG. 9 will be described below.

First, the pre-decoder will be described.

Figure 10:
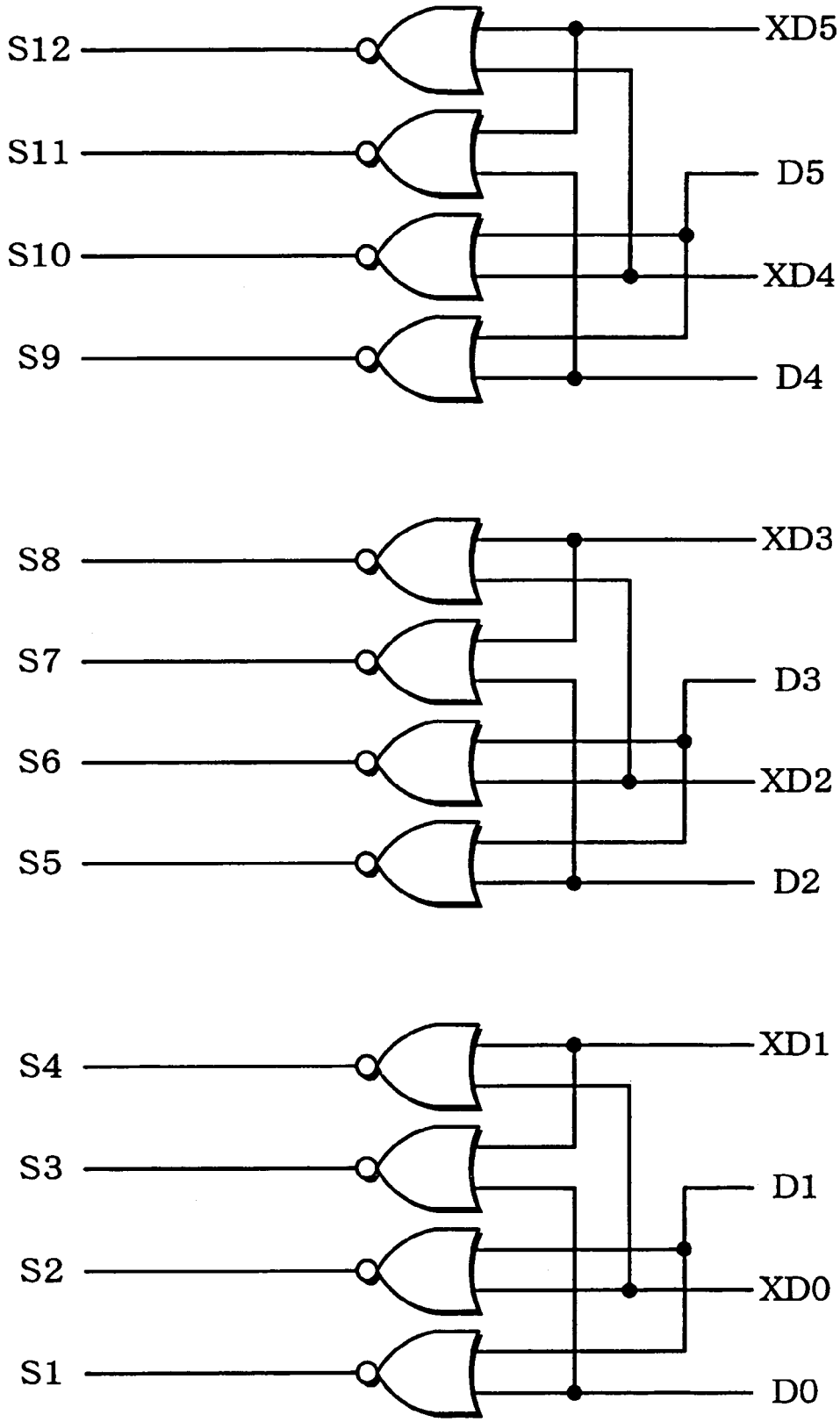
FIG. 10 is a circuit diagram showing a configuration example of a pre-decoder in the present embodiment.

FIG. 10 shows a configuration example of the pre-decoder.

This pre-decoder is installed in each decoder of the first and the second decoders DEC1 and DEC2. In 6-bit gray scale data D5-D0, an upper order bit side is D5 and a low order bit side is D0. If we take 1 bit of the gray scale data as Dx ($0 \leqq x \leqq 5$, where xi is an integer), XDx is inverse data of the D.

This pre-decoder generates gate signals S1-S12. The gate signals S9-S12 are generated based on upper order 2 (a=2)-bit of the gray scale data. Specifically, the gate signals S9-S12 are generated based on upper order 2 bits data D5 and D4 of the gray scale data and inverse data thereof XD5 and XD4.

With respect to the gray scale data D5 and D4, the gray scale data D3-D0 can be said as low order 4-bit data of the gray scale data. In the present embodiment, the low order 4-bit is further split into intermediate order 2-bit and low order 2-bit with respect to the intermediate order 2-bit.

Gate signals S5-S8 are generated based on the intermediate order 2 (b=2)-bit data of the gray scale data. Specifically, the gate signals S5-S8 are generated based on the intermediate order 2-bit data D3 and D2 of the gray scale data and inverse data thereof XD3 and XD2.

The gate signals S1-S4 are generated based on low order 2 (c=2)-bit data of the gray scale data. Specifically, the gate signals S1-S4 are generated based on low order 2-bit data D1 and D0 of the gray scale data and inverse data thereof XD1 and XD0.

The gate signals XS1-XS12 are signals which respectively inverted the gate signals S1-S12, and may be generated by the pre-decoder shown in FIG. 10.

Figure 11:
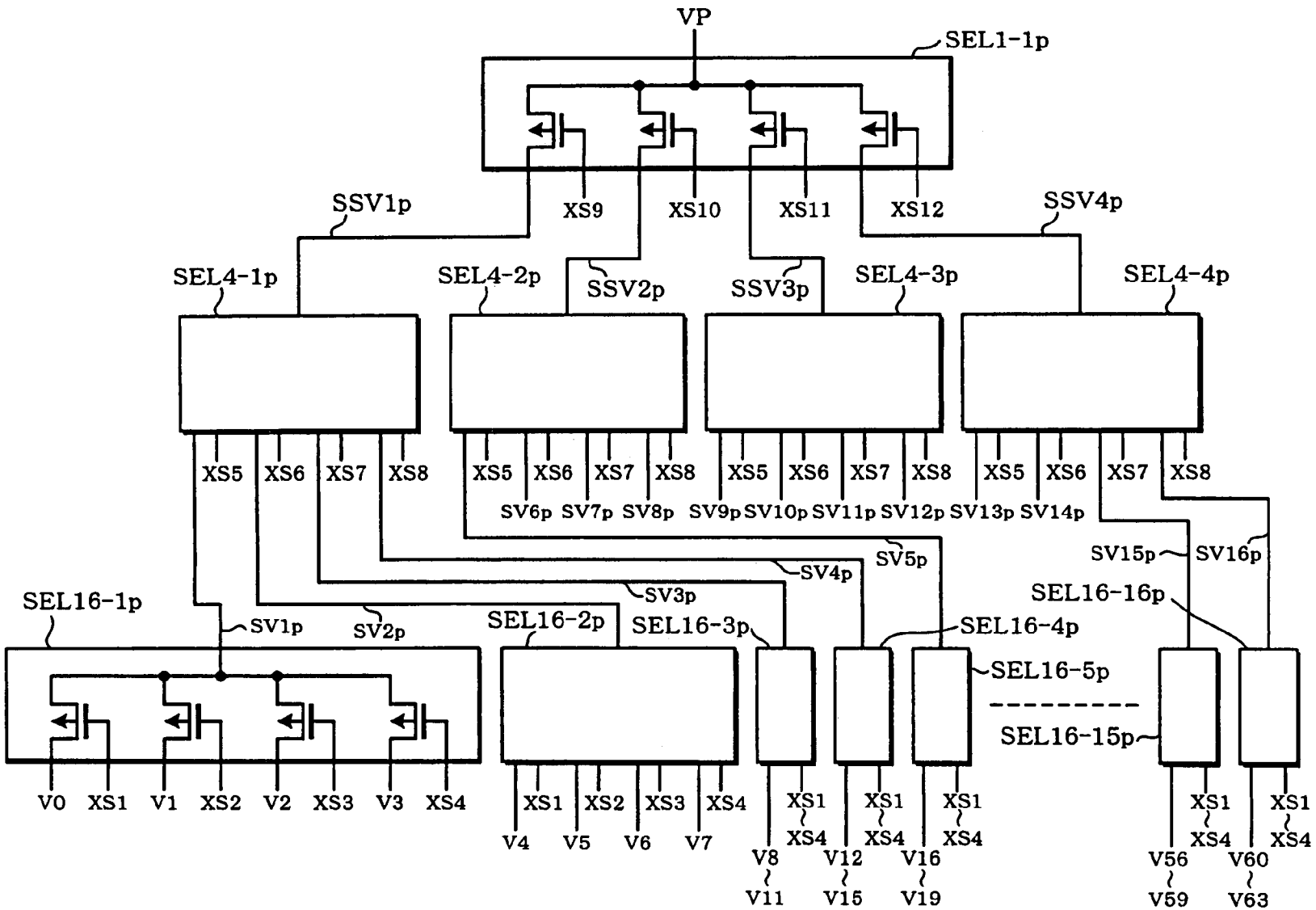
FIG. 11 is a circuit diagram of a configuration example of p-type selectors of FIG. 9.

A configuration example of the p-type selector SELp is shown in FIG. 11.

As shown in FIG. 11, the first p-type selector SEL1-1*p* has a plurality of p-type MOS transistors, on a gate of each of which a gate signal XS9-XS12 corresponding to upper order 2 (=a)-bit data of the gray scale data is impressed, and one drain of the each of which is electrically connected to the other drains. A voltage of the connection node among one drain and the other drains of each p-type MOS transistor becomes an input voltage of the first operational amplifier OP1 as the gray scale voltage VP.

The p-type selector SELp further includes 4 ($=2^2$) pieces of p-type second selectors SEL4-1*p*-SEL 4-4*p*. Configuration of each second selector is identical and identical to configuration of the p-type first selector SEL1-1*p*.

Each of the second p-type selectors SEL4-1*p*-4-4*p* has a plurality of p-type MOS transistors, on the gate of each of which gate signals XS5-XS8 corresponding to intermediate order a-bit data of the gray scale data are impressed, and one drain of the each of which is electrically connected to the other drains. A node electrically connecting one drain of each p-type MOS transistor to the other drains is electrically connected to any of the sources of the p-type MOS transistors constituting the p-type first selector SEL1-1*p*.

The p-type first selector SELp further includes 16 ($=2^{2+2}$) pieces of p-type third selectors SEL4-1*p*-SEL16-1*p*-SEL16-16*p*. Configuration of each third selector is identical and identical to configuration of the p-type first selector SEL1-1*p*.

The p-type third selector SE16-1*p*-16-16*p* has a plurality of p-type MOS transistors, one the gate of each of which gate signals XS1-XS4 corresponding to the intermediate order 2 (=c)-bit data of the gray scale data is impressed on, and one drain of the each of which is electrically connected to the other drains. A node electrically connecting one drain of each p-type MOS transistor to the other drains is electrically connected to any of the sources of the p-type MOS transistors constituting the p-type second selectors SEL4-1*p*-SEL4-4*p*.

To be more specific, the node of the p-type third selectors SEL 16-1*p*-SEL16-4*p* is electrically connected to any of the sources of the p-type MOS transistors constituting the p-type second selector SEL4-1*p*. The node of the p-type third selectors SEL16-5*p*-SEL16-8*p* is electrically connected to any of the sources of the p-type MOS transistors constituting the p-type second selector SEL4-2*p*. The node of the p-type third selectors SEL16-9*p*-SEL16-12*p* is electrically connected to any of the sources of the p-type MOS transistors constituting the p-type second selector SEL4-3*p*. The node of the p-type third selectors SEL16-13*p*-SEL16-16*p* is electrically connected to any of the sources of the p-type MOS transistors constituting the p-type second selector SEL4-4*p*.

Also, gray scale voltages V0-V3 are respectively supplied to the source of each p-type MOS transistor constituting the p-type third selector SEL16-1*p*. Gray scale voltages V4-V7 are respectively supplied to the source of each p-type MOS transistor constituting the p-type third selector SEL16-2*p*. Likewise, the gray scale voltage shown in FIG. 11 is also supplied to the source of each p-type MOS transistor constituting other p-type third selectors.

Figure 12:
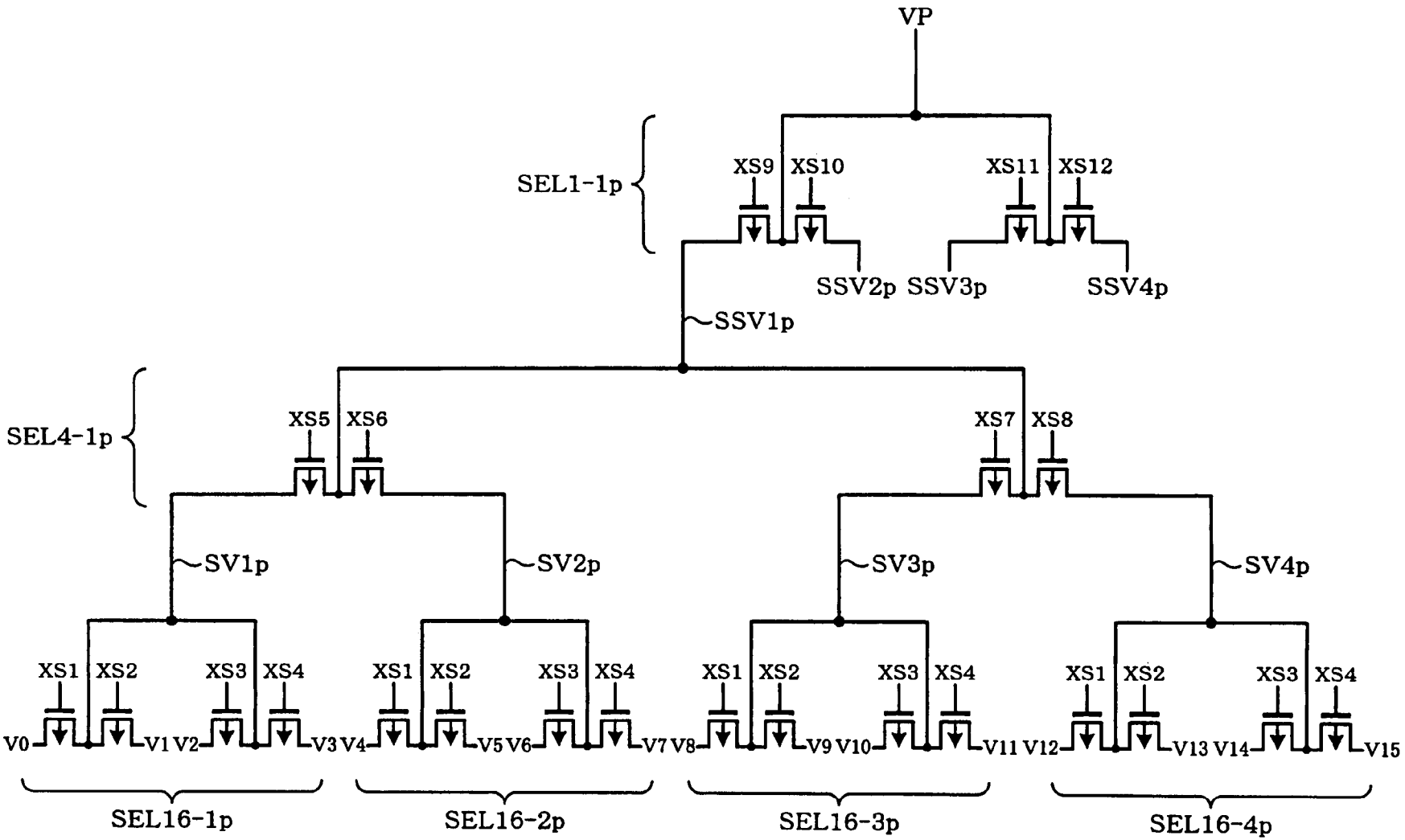
FIG. 12 is an explanatory diagram of part of an example of paths formed by the p-type selectors of FIG. 9.

In FIG. 12, there is shown an explanatory diagram of part of an example of the path P1 formed in the p-type selector SELp of FIG. 11.

As mentioned above, every gray scale voltage generates in each resistance split node of the reference voltage generating circuit 527. And a path from the resistance split node to the input to the first operational amplifier OP1 is determined by a gate signal generated based on the gray scale data.

For example, when the gray scale voltage V3 is selected, a p-type transistor having gate signals XS4, XS5, and XS9 will be passed, so that the number of transistors, through which the path passes, becomes 3 in the p-type selector SELp.

Figure 13:
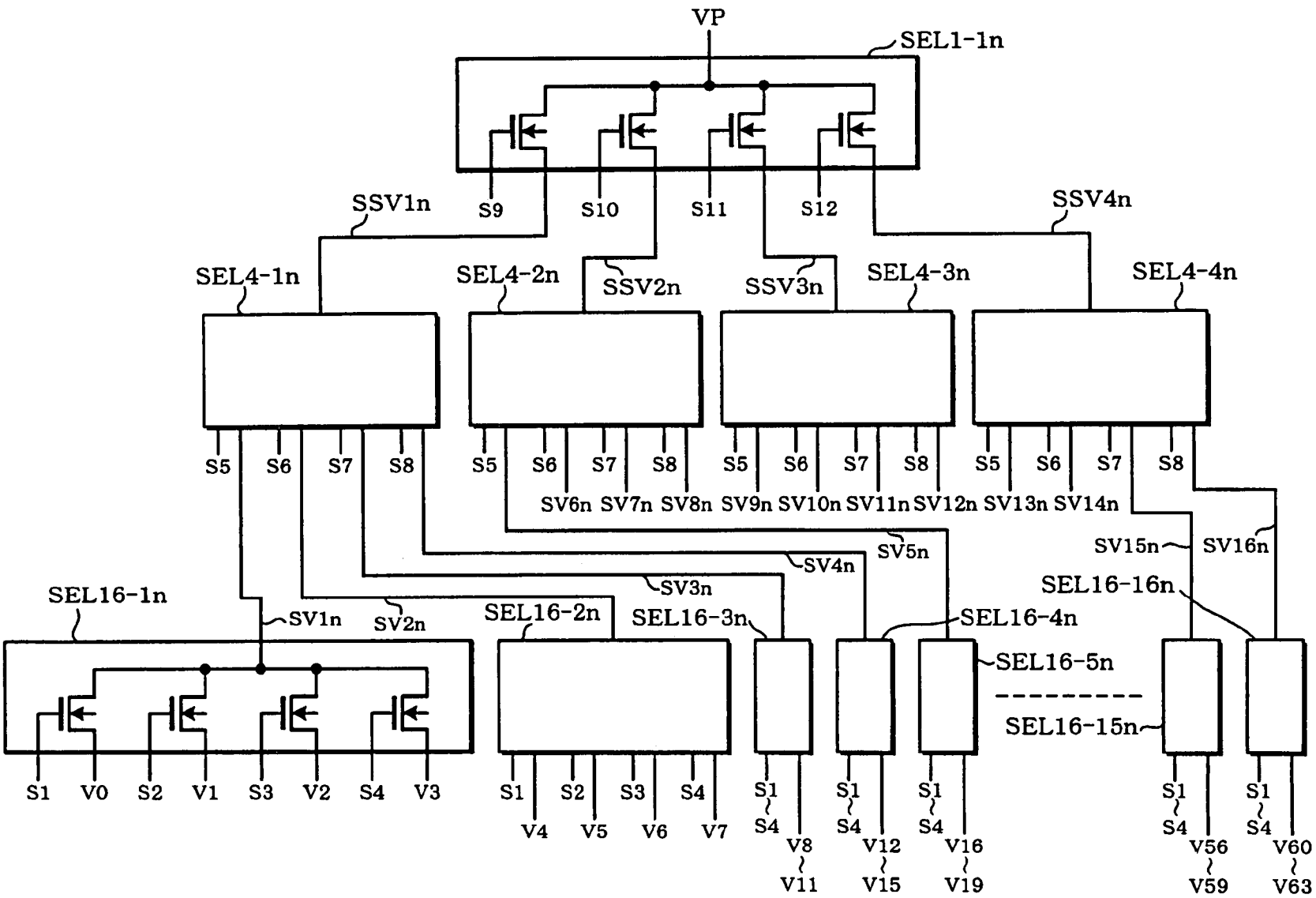
FIG. 13 is a circuit diagram of a configuration example of the n-type selectors of FIG. 9.

In FIG. 13, there is shown a configuration example of an n-type selector SELn.

As shown in FIG. 13, the n-type first selector SEL1-1*n* has a plurality of n-type MOS transistors, on the gate of each of which gate signals S9-S12 corresponding to the upper order 2 (=a)-bit data of the gray scale data are impressed on, and one drain of the each of which is electrically connected to the other drains. A voltage of the connection node among one drain of each n-type MOS transistor and the other drains becomes an input voltage of the first operational amplifier OP1 as the gray scale voltage VP.

The n-type selector SELn further includes 4 ($=2^2$) pieces of n-type second selectors SEL4-1*n*-SEL4-4*n*. Configuration of each second selector is identical and identical to configuration of the n-type first selector SEL1-1*n*.

The n-type first selector SEL4-1*n*-SEL4-4*n* respectively have a plurality of n-type MOS transistors in which gate signals S5-S8 corresponding to 2 (=b)-bit data of the gray scale data is impressed on a gate of each n-type MOS transistor, and one drain of the each n-type MOS transistor is electrically connected to the other drains. And a voltage of the connection node between one drain to the other drains of each n-type MOS transistor is electrically connected to any of the sources of the n-type MOS transistors constituting the n-type first selector SEL1-1*n*.

The n-type selector SELn further includes 16 ($=2^{2+2}$) pieces of n-type third selectors SEL16-1*n*-SE16-16*n*. Configuration of each third selector is identical and identical to configuration of the n-type first selector SEL1-1*n*.

The n-type third selectors SEL16-1*n*-SEL16-16*n* respectively have a plurality of n-type MOS transistors, on the gate of each of which gate signals S1-S4 corresponding to the low order 2 (=c)-bit data of the gray scale data is impressed on, and one drain of the each of which is electrically connected to the other drains. And a node among one drain of each n-type MOS transistor and the other drains is electrically connected to any of the sources of the n-type MOS transistors constituting the n-type second selectors SEL4-1*n*-SEL4-4*n*.

To be more specific, the node of the n-type third selectors SEL 16-1*n*-SEL16-4*n* is electrically connected to any of the sources of the n-type MOS transistors constituting the n-type second selector SEL4-1*n*. The node of the n-type third selectors SEL16-5*n*-SEL16-8*n* is electrically connected to any of the sources of the n-type MOS transistors constituting the n-type second selector SEL4-2*n*. The node of the n-type third selectors SEL 16-9*n*-SEL16-12*n* is electrically connected to any of the sources of the n-type MOS transistors constituting the n-type second selector SEL4-3*n*. The node of the n-type third selector SEL16-13*n*-SEL16-16*n* is electrically connected to any of the sources of the n-type MOS transistors constituting the n-type second selector SEL4-4*n*.

Further, gray scale voltages V0-V3 are respectively supplied to the source of each n-type MOS transistor constituting the n-type third selector SEL16-1*n*. The gray scale voltages V4-V7 are respectively supplied to the source of each n-type MOS transistor constituting the n-type third selector SEL16-2*n*. Likewise, the gray scale voltage shown in FIG. 13 is also supplied to the source of each n-type MOS transistor constituting other n-type third selectors.

Figure 14:
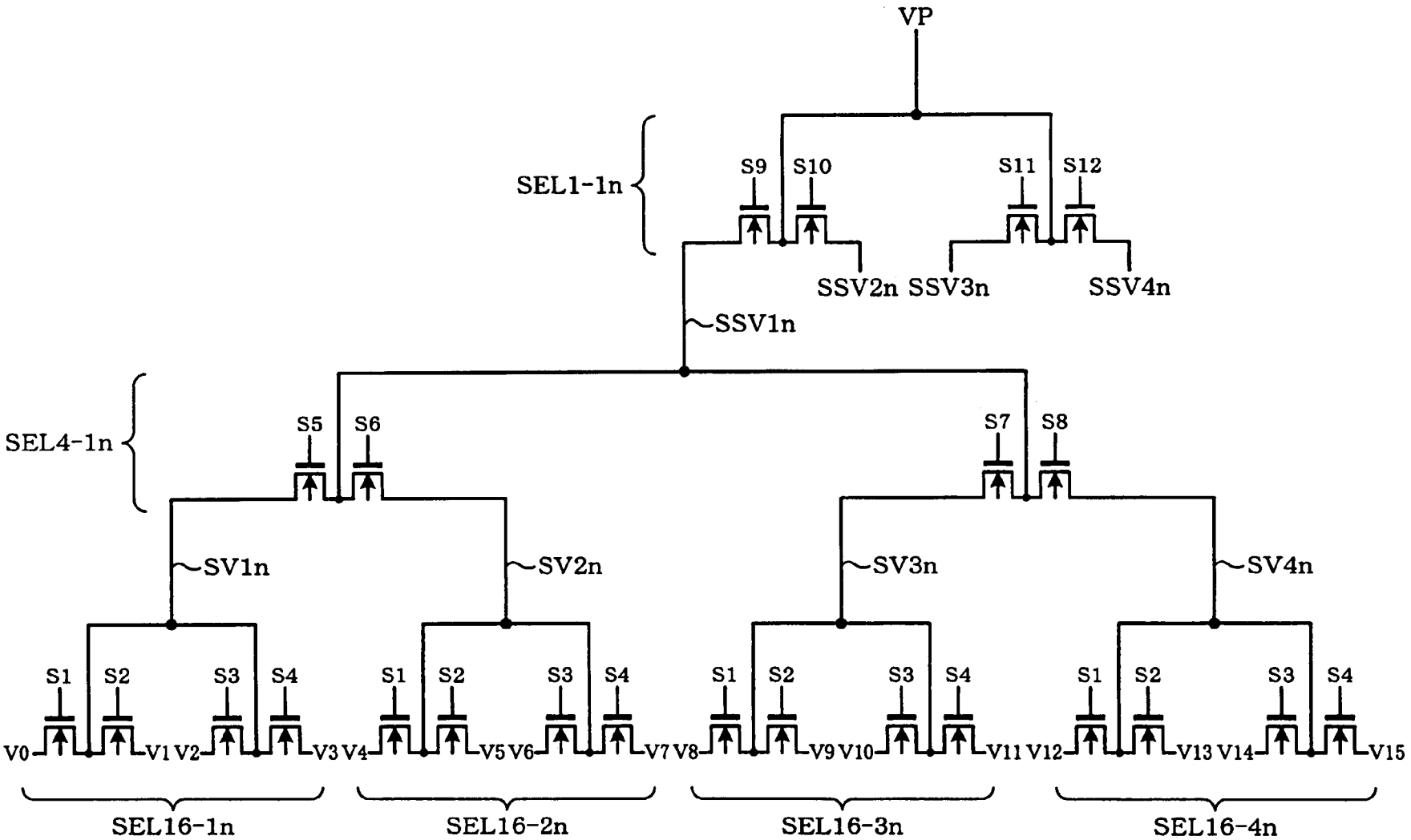
FIG. 14 is an explanatory diagram of part of an example of paths formed by the n-type selectors of FIG. 13.

In FIG. 14, there is shown part of an example of the path P1 formed in the n-type selector SELn of FIG. 13.

As explained in FIG. 12, for example, when the gray scale voltage 3V is selected, an n-type transistor having gate signals S4, S5, and S9 will be passed, so that the number of transistors, through which the path passes, becomes 3 in the n-type selector SELn.

Figure 15:
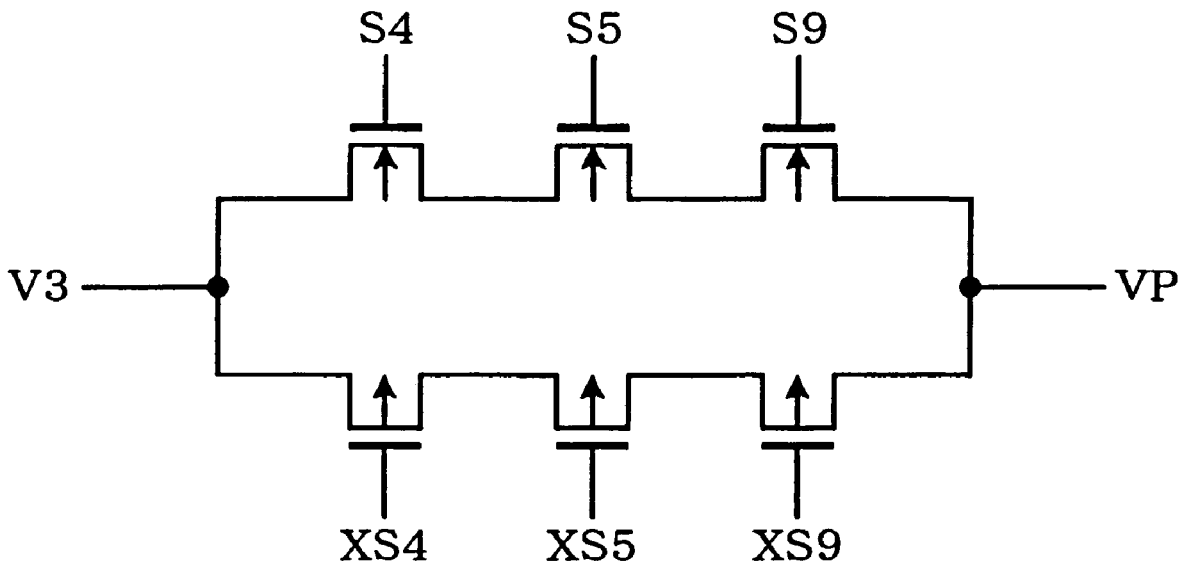
FIG. 15 is an explanatory diagram of an input path of the graded voltage formed by the first decoder in the present embodiment.

In FIG. 15, there is shown an explanatory diagram of the path P1 in the first decoder DEC1. In FIG. 15, a path when the gray scale voltage V3 is selected is shown, as shown in FIG. 12 and FIG. 14.

In the present embodiment, the gate signals S1-S12 generated by the pre-decoder shown in FIG. 10 are impressed on the n-type MOS transistors of the n-type selector SELn, and the gate signals XS1-XS12 which are the gate signals S1-S12 respectively inverted are impressed on the p-type MOS transistors of the p-type selector SELn. As a result, when the gray scale voltage V3 is selected in the n-type selector SELn, the gray scale voltage V3 is also selected in the p-type selector SELp. Consequently, a path such as in FIG. 15 is formed.

By setting up foregoing configuration of the first decoder DEC1 corresponding to each data line as the voltage generating circuit, it is sufficient for the path P1 shown in FIG. 7 to pass through 6 transistors. Consequently, by comparison to a case of description in FIGS. 8A and B, impedance governed by the on resistance of the transistor may be decreased to one-fourth, so that the voltage drop in the first and the second decoders DEC1 and DEC2 may be prevented.

Further, by making circuit configuration of the first and the second decoders DEC1 and DEC2 in a manner described above, the following layout arrangement may be realized, thereby obtaining various effects.

Figure 16:
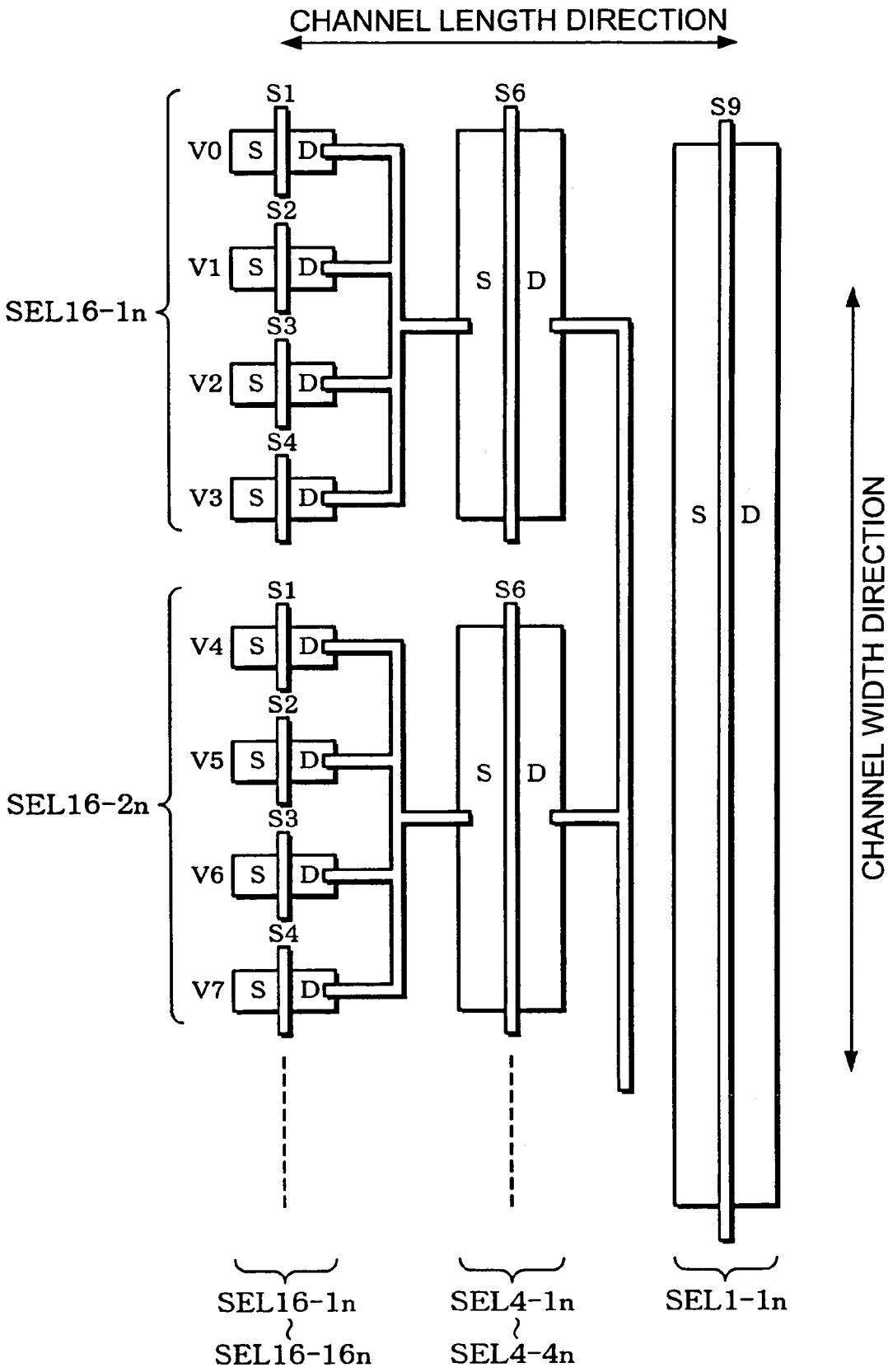
FIG. 16 is a schematic plan view of a layout arrangement of the n-type selectors.

In FIG. 16, there is shown a schematic plan view of the layout arrangement of the n-type selector SELn.

It should be noted that in FIG. 16, there is illustrated only a wiring layer that electrically connects the source area S, the drain area D and the gate electrode, and each MOS transistor, and other illustrations are omitted. For example, the gate signal S1 is supplied to the gate electrodes of the MOS transistors constituting the third selector, and the drain electrode of the transistor, on whose source area is impressed the gray scale voltage V0, is connected, through the wiring layer, to the source area of the MOS transistor of the second selector, to which the gate signal S5 is supplied.

In the n-type selector SELn, the number of first selectors is fewer than the number of the second selectors. Suppose that the channel width direction is the direction indicated in FIG. 16, then the channel length direction is in a direction intersecting the channel width direction. And, in the direction intersecting the channel width direction, there is placed each n-type MOS transistor constituting $2^2$ ($=2^a$) pieces of the second selectors SEL4-1*n*-SEL4-4*n*. At this time, it is arranged such that the channel width direction of each MOS transistor constituting the n-type first and the second selectors SEL1-1*n*, SEL4-1*n*-SEL4-4*n* is parallel.

By doing so, the on resistance of each MOS transistor constituting the n-type first selector SEL1-1*n* can be made less than the on resistance of each MOS transistor constituting the n-type second selectors SEL4-1*n*-SEL4-4*n*. This is because, as mentioned above, the number of the first selectors is fewer than the number of the second selectors, so that without enlarging wastefully the layout arrangement area, the channel width of the MOS transistors constituting the first selectors can be made larger than the channel width of the MOS transistors constituting the first selector.

As shown in FIG. 13 and FIG. 14, the selected path of the gray scale voltage will pass through the MOS transistors constituting the first selector with certainty. Hence, the voltage drop can be effectively prevented by lowering the on resistance of the MOS transistors constituting the first selector.

It should be noted that in FIG. 16, description was made about the first and the second selectors, while it is possible to obtain the same effects through securing the layout area likewise in regard to the second and the third selectors. Namely, the voltage drop can be effectively prevented, by lowering the on resistance of the MOS transistors constituting the second selector, by comparison to the case of lowering the on resistance of the MOS transistors of the third selector.

Also, in FIG. 16, the schematic diagram of layout arrangement of the n-type selector SEL, while the same can be realized in regard to the layout arrangement of the p-type selector SELp.

Figure 17A:
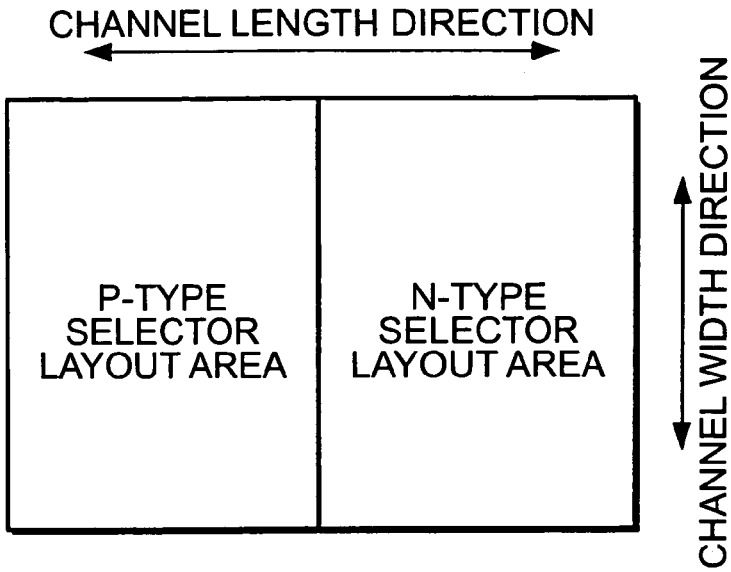
FIGS. 17A and B are diagrams showing an example of layout arrangements of the n-type selector and the p-type selector.

In FIGS. 17A and B, there is shown an example of layout arrangement of the n-type selector SELn and the p-type selector SELp.

In FIG. 17A, the p-type selector SELp and the n-type selector SELn are placed such that they are adjacent in the channel length direction. For example, if the first operational amplifier OP1 is located in the channel width direction shown in FIG. 17A, this is adopted when there is a margin in a distance between output electrodes to which the output of each operational amplifier is connected.

Figure 17B:
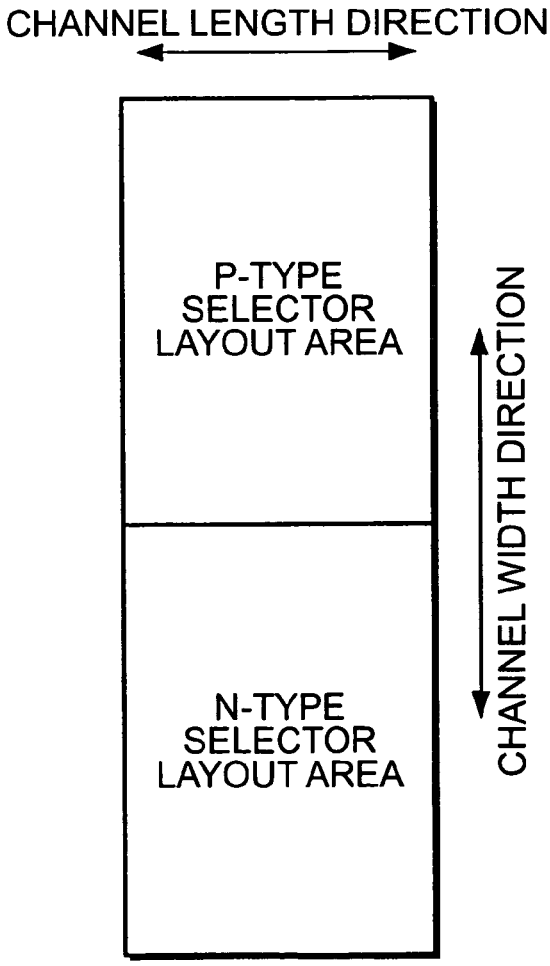

In FIG. 17B, the p-type selector SELp and the n-type selector SELn are placed such that they are adjacent in the channel width direction. For example, if the first operational amplifier OP1 is located in the channel width direction shown in FIG. 17B, this is effective when there is no margin in a distance between output electrodes to which the output of each operational amplifier is connected.

It should be noted that the present invention is not limited to the above-mentioned embodiment but various modifications are possible within the spirit and scope of the present invention. For example, the present invention is not only applicable to the above-mentioned drive of a liquid crystal panel but also applicable to the drive of electro-luminescence and plasma display devices.

In the embodiment described above, description was provided of the gray scale data of 6 bits, but it is not limited to this. The same applies when the gray scale data is 2-5 bits or over 7 bits.

Further, in the present embodiment, although description was provided when the above-mentioned voltage generating circuit is applied to the DAC of the data driver, it is by no means limited by it. The above-mentioned voltage generating circuit is applicable to what selects the generated voltage corresponding to the digital data out of a plurality of generated voltages.

Still further, in the invention associated with a dependent claim of the present invention, configuration may be such that omits part of the structural elements of a dependent claim. Furthermore, the principal part of the invention associated with one independent claim of the invention may be made such as to be dependent on other independent claims.

What is claimed is:

1. A voltage generating circuit for outputting, out of a plurality of generated voltages, a generated voltage corresponding to (a+b+c) bits of digital data (where a, b, and c are positive integers), wherein low order bits of the digital data include the (b+c) bits and upper order bits of the digital data include the a bits, comprising:

a first selector of a first conductive type being constituted by a first conductive type MOS transistor and outputting any of generated voltages selected corresponding to the low order bits of the digital data based on the upper order bits of the digital data;

$2^a$ second selectors of the first conductive type, each second selector being constituted by the first conductive type MOS transistors, and each second selector outputting any of the plurality of the generated voltages, based on the low order bits of the digital data, to the first selector of the first conductive type;

a first selector of a second conductive type being constituted by a second conductive type MOS transistor outputting any of generated voltages selected corresponding to the low order bits of the digital data, based on the upper order bits of the digital data; and $2^a$ second selectors of the second conductive type, each second selector being constituted by the second conductive type MOS transistor, and each second selector outputting any of the plurality of the generated voltages, based on the low order bits of the digital data, to the first selector of the second conductive type, wherein:

a generated voltage corresponding to the (a+b+c) bits of the digital data is outputted from a first node in which an output of the first selector of the first conductive type and an output of the first selector of the second conductive type are connected.

2. The voltage generating circuit according to claim 1, wherein:

the first selector of the first conductive type has a plurality of first conductive type MOS transistors each having a gate, a drain, and a source, on the gate of each of which a signal corresponding to the a bits of the digital data is impressed, and the drains are electrically connected together;

the first selector of the second conductive type has a plurality of second conductive type MOS transistors each having a gate, a drain, and a source, on the gate of each of which the gate signal corresponding to the a bits of the digital data is impressed, and the drains are electrically connected together; and each of the $2^a$ second selectors of the first conductive type has a plurality of first conductive type MOS transistors each having a gate, a drain, and a source, on the gate of each of which the gate signal corresponding to the b bits of the digital data is impressed, and the drains are electrically connected together, wherein:

one of the drains of the first conductive type MOS transistors constituting one of the $2^a$ second selectors of the first conductive type is electrically connected to one of the sources of the first conductive type MOS transistors constituting the first selector of the first conductive type;

each of the second selectors of the second conductive type has a plurality of the second conductive type MOS transistors each having a gate, a drain, and a source, on the gate of each of which the gate signal corresponding to the b bits of the digital data is impressed, and the drains are electrically connected together, wherein:

one of the drains of the second conductive type MOS transistors constituting one of the $2^a$ second selectors of the second conductive type is electrically connected one of the sources of the second conductive type MOS transistors constituting the first selector of the second conductive type; and drains of the first conductive type MOS transistors constituting the first selector of the first conductive type are electrically connected to the drains of the second conductive type MOS transistors constituting the first selector of the second conductive type.

3. The voltage generating circuit according to claim 2, wherein:

the first conductive type MOS transistors constituting the $2^a$ second selectors of the first conductive type are linearly arranged in a first direction;

the first conductive type MOS transistors constituting the first selector of the first conductive type is linearly arranged in a second direction that is parallel to the first direction; and an on resistance of each of the first conductive type MOS transistors constituting the first selector of the first conductive type is less than an on resistance of each of the first conductive type MOS transistors constituting the $2^a$ second selectors of the first conductive type.

4. The voltage generating circuit according to claim 3, wherein:

the channel width of each first conductive type MOS transistor constituting the first selector of the first conductive type is larger than the channel width of each first conductive type MOS transistor constituting the second selector of the first conductive type.

5. The voltage generating circuit according to claim 1, wherein:

the digital data is gray scale data; and the generated voltage is a gray scale voltage.

6. A data driver driving the plurality of data lines of an electro-optical device including a plurality of scanning lines and a plurality of data lines, comprising:

the voltage generating circuit according to claim 5; and a drive circuit driving a data line based on a gray scale voltage outputted by the voltage generating circuit.

7. A display unit comprising:

a plurality of scanning lines;

a plurality of data lines;

a plurality of switching elements, each of which is connected to each scanning line and each data line;

a scanning driver scanning the plurality of scanning lines; and a data driver according to claim 6 driving the plurality of data lines.

* * * * *